US011712791B2

(12) United States Patent
Shioya et al.

(10) Patent No.: US 11,712,791 B2
(45) Date of Patent: Aug. 1, 2023

(54) DRIVING TOOL

(71) Applicant: Koki Holdings Co., Ltd., Tokyo (JP)

(72) Inventors: Koji Shioya, Ibaraki (JP); Takashi Ueda, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 300 days.

(21) Appl. No.: 17/048,616

(22) PCT Filed: Mar. 29, 2019

(86) PCT No.: PCT/JP2019/014016
§ 371 (c)(1),
(2) Date: Oct. 19, 2020

(87) PCT Pub. No.: WO2019/208104
PCT Pub. Date: Oct. 31, 2019

(65) Prior Publication Data

US 2021/0146517 A1 May 20, 2021

(30) Foreign Application Priority Data

Apr. 26, 2018 (JP) ..... 2018-085321
Oct. 31, 2018 (JP) ..... 2018-205641

(51) Int. Cl.
*B25C 1/06* (2006.01)
*B25C 1/04* (2006.01)
*B25C 7/00* (2006.01)

(52) U.S. Cl.
CPC ..... *B25C 1/06* (2013.01); *B25C 1/047* (2013.01); *B25C 1/043* (2013.01); *B25C 7/00* (2013.01)

(58) Field of Classification Search
CPC ..... B25C 1/06; B25C 1/047; B25C 1/043; B25C 7/00
See application file for complete search history.

(56) References Cited

U.S. PATENT DOCUMENTS

2009/0090759 A1* 4/2009 Leimbach ..... B25C 1/06 227/10
2019/0091844 A1* 3/2019 Akiba ..... B25C 1/06

FOREIGN PATENT DOCUMENTS

| | | |
|---|---|---|
| JP | 2008260124 | 10/2008 |
| JP | 2008264970 | 11/2008 |
| JP | 2012236250 | 12/2012 |
| JP | 2014069289 | 4/2014 |
| JP | 2015009313 | 1/2015 |

(Continued)

OTHER PUBLICATIONS

"International Search Report (Form PCT/ISA/210) of PCT/JP2019/014016," dated Jun. 25, 2019, with English translation thereof, pp. 1-8.

*Primary Examiner* — Anna K Kinsaul
*Assistant Examiner* — Veronica Martin
(74) *Attorney, Agent, or Firm* — JCIPRNET

(57) ABSTRACT

The disclosure provides a driving tool. The driving tool includes an ejection part, a pressure accumulator, a striking part, a driving part, and a housing. The driving tool includes a cylinder forming at least a part of the pressure accumulator, and a piston formed in the striking part. The driving part and a wire material are entirely disposed outside, in the radial direction of the cylinder, a region in which the piston is arranged, and outside a region in which the piston slides in an operating direction of the striking part with respect to the cylinder.

14 Claims, 33 Drawing Sheets

(56) References Cited

FOREIGN PATENT DOCUMENTS

| | | |
|---|---|---|
| JP | 2016047594 | 4/2016 |
| WO | 2017179491 | 10/2017 |

* cited by examiner

DRIVING TOOL

CROSS-REFERENCE TO RELATED APPLICATION

This application is a 371 application of the International PCT application serial no. PCT/JP2019/014016, filed on Mar. 29, 2019, which claims the priority benefit of Japanese Patent Application No. 2018-085321, filed on Apr. 26, 2018 and Japanese Patent Application No. 2018-205641, filed on Oct. 31, 2018. The entirety of each of the above-mentioned patent applications is hereby incorporated by reference herein and made a part of this specification.

BACKGROUND

Technical Field

The present invention relates to a driving tool including a striking part configured to strike a fastener.

Description of Related Art

Patent Literature 1 (Japanese Patent Application Laid-Open No. 2014-069289) discloses an example of a driving tool including a striking part operated in a first direction at a pressure of a compressible gas, and a driving part configured to operate the striking part in a second direction opposite to the first direction. The driving tool of Patent Literature 1 has a housing, the striking part, an ejection part, a blocking mechanism, a bellows and the driving part. The ejection part is fixed to the housing, and the striking part has a piston and a driver blade. A first end portion of the bellows is connected to the piston, and a second end portion of the bellows is fixed in the housing. A pressure accumulator is formed in the bellows, and a compressible gas is enclosed in the pressure accumulator.

The driving part has an electric motor, a pair of gears, a belt wound on the pair of gears, a rotating shaft, a rotating shaft to which the gears are fixed, a winding body attached to the rotating shaft, and a wire, a first end portion of the wire is wound on a pulley, and a second end portion of the wire is connected to the piston. The blocking mechanism connects and disconnects a route through which a rotating force of the rotating shaft is transmitted to the pulley. The pair of gears and the belt are disposed outside the bellows in the radial direction with respect to a region in which the bellows configured to form the pressure accumulator is disposed. In addition, the bellows is disposed between the ejection part and the winding body in an operating direction of the striking part.

In the driving tool disclosed in Patent Literature 1, when an operating force is applied to a trigger, the electric motor is rotated. In addition, since the blocking mechanism connects the route, the rotating force of the electric motor is transmitted to the pulley via the gears and the belt. When the pulley winds the wire, the striking part is operated in the second direction against the pressure of the pressure accumulator. Next, when a blocking mechanism blocks the route, the striking part is operated in the first direction at the pressure of the pressure accumulator, and strikes a nail in the ejection part.

SUMMARY

Technical Problem

The inventor(s) of the application has recognized that leakage of a compressible gas in a pressure accumulator and an increase in size of a driving tool may occur according to disposition positions of a striking part and a driving part.

The present invention provides a driving tool capable of improving sealability of a pressure accumulator and minimizing an increase in size thereof.

Solution to Problem

A driving tool of an embodiment is a driving tool including: an ejection part to which a fastener is supplied, a pressure accumulator that accumulates a compressible gas, a striking part operated in a first direction to strike the fastener with a pressure of the compressible gas, a wire material connected to the striking part, a driving part that operates the striking part in a second direction opposite to the first direction and increase the pressure in the pressure accumulator by pulling the wire material, and a housing in which at least one of the pressure accumulator, the striking part and the driving part is provided, wherein a cylinder that forms at least a part of the pressure accumulator and has a centerline disposed in an operating direction of the striking part, and a piston that is formed in the striking part and slid with respect to an inner circumferential surface of the cylinder when the striking part is operated in the centerline direction are provided, and a connection place of the driving part and the wire material is in a region of the piston in a radial direction of the cylinder, outside a sliding region of the piston in the operating direction of the striking part, and on the first direction side of the piston.

A driving tool of another embodiment is a driving tool including: an ejection part to which a fastener is supplied, a pressure accumulator that accumulates a compressible gas, a striking part operated in a first direction to strike the fastener with a pressure of the compressible gas, a shock absorbing member with which the striking part operated in the first direction is in contact, a wire material connected to the striking part, a driving part that operates the striking part in a second direction opposite to the first direction and increase the pressure in the pressure accumulator by pulling the wire material, and a housing in which at least one of the pressure accumulator, the striking part and the driving part is provided, wherein a connection place of the driving part and the entire wire material are provided between the shock absorbing member and a tip of the ejection part furthest from the shock absorbing member in the operating direction of the striking part.

A driving tool of yet another embodiment is a driving tool including: an ejection part to which a fastener is supplied, a pressure accumulator that accumulates a compressible gas, a striking part operated in a first direction to strike the fastener with a pressure of the compressible gas, a wire material connected to the striking part, a driving part that operates the striking part in a second direction opposite to the first direction and increase the pressure in the pressure accumulator by pulling the wire material, and a housing in which at least one of the pressure accumulator, the striking part and the driving part is provided, wherein the driving part includes: a rotating member; and an engagement part that is provided on the rotating member and able to be engaged with and disengaged from the wire material, and the rotating member is rotated to pull the wire material in a state in which the engagement part is engaged with the wire material.

Effects

A driving tool of an embodiment can improve sealability of a pressure accumulator and minimize an increase in size thereof.

DESCRIPTION OF EMBODIMENTS

Typical embodiments among some embodiments of a driving tool included in the present invention will be described with reference to the accompanying drawings.

Embodiment 1

Figure 1:
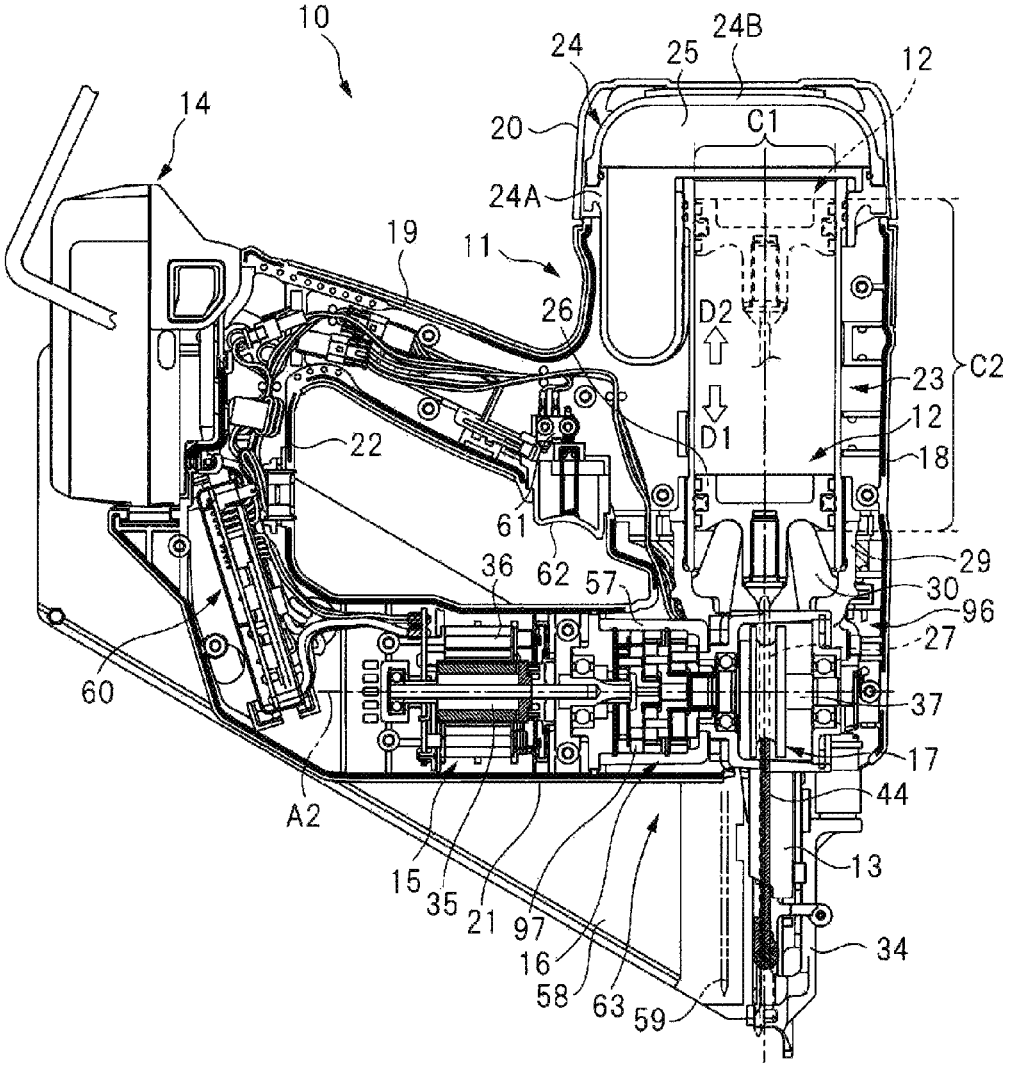
FIG. 1 is a front cross-sectional view showing an embodiment of a driving tool included in the present invention.

A driving tool 10 shown in FIGS. 1 and 2 has a housing 11, a striking part 12, a nose 96, a power supply unit 14, an electric motor 15, a driving part 63, a speed reducer 16 and a converting part 17. The housing 11 has a cylinder case 18, a handle 19, a head cover 20, a motor case 21 and a connecting part 22. The cylinder case 18 is hollow, and the handle 19 is connected to the cylinder case 18. The motor case 21 is connected to the cylinder case 18, and the connecting part 22 is connected to the handle 19 and the motor case 21. The head cover 20 is attached to cover an opening part of the cylinder case 18.

A cylinder 23 is accommodated in the cylinder case 18. A tank 24 is disposed throughout the inside of the cylinder case 18 and the inside of the head cover 20. The tank 24 has an annular holder 24A, and a cap 24B fixed to the holder 24A. The holder 24A supports an outer circumferential surface of the cylinder 23 in a radial direction. The cylinder case 18 and the head cover 20 are arranged in a centerline A1 direction. The cap 24B is disposed in the head cover 20, and the cap 24B and the cylinder 23 are arranged in the centerline A1 direction.

As shown in FIG. 1, the cylinder 23 is disposed between the head cover 20 and the nose 96 in the centerline A1 direction. The entire disposition region of the cylinder 23 is disposed in a disposition region of the tank 24 when seen in a plan view perpendicular to the centerline A1.

A pressure accumulator 25 is formed throughout the inside of the cylinder 23 and the inside of the tank 24. The pressure accumulator 25 is filled with a compressible gas. An inert gas can be used as the compressible gas in addition to air. Examples of the inert gas include nitrogen gas and rare gases. In the embodiment, an example in which the pressure accumulator 25 is filled with air will be described.

Figure 2A:
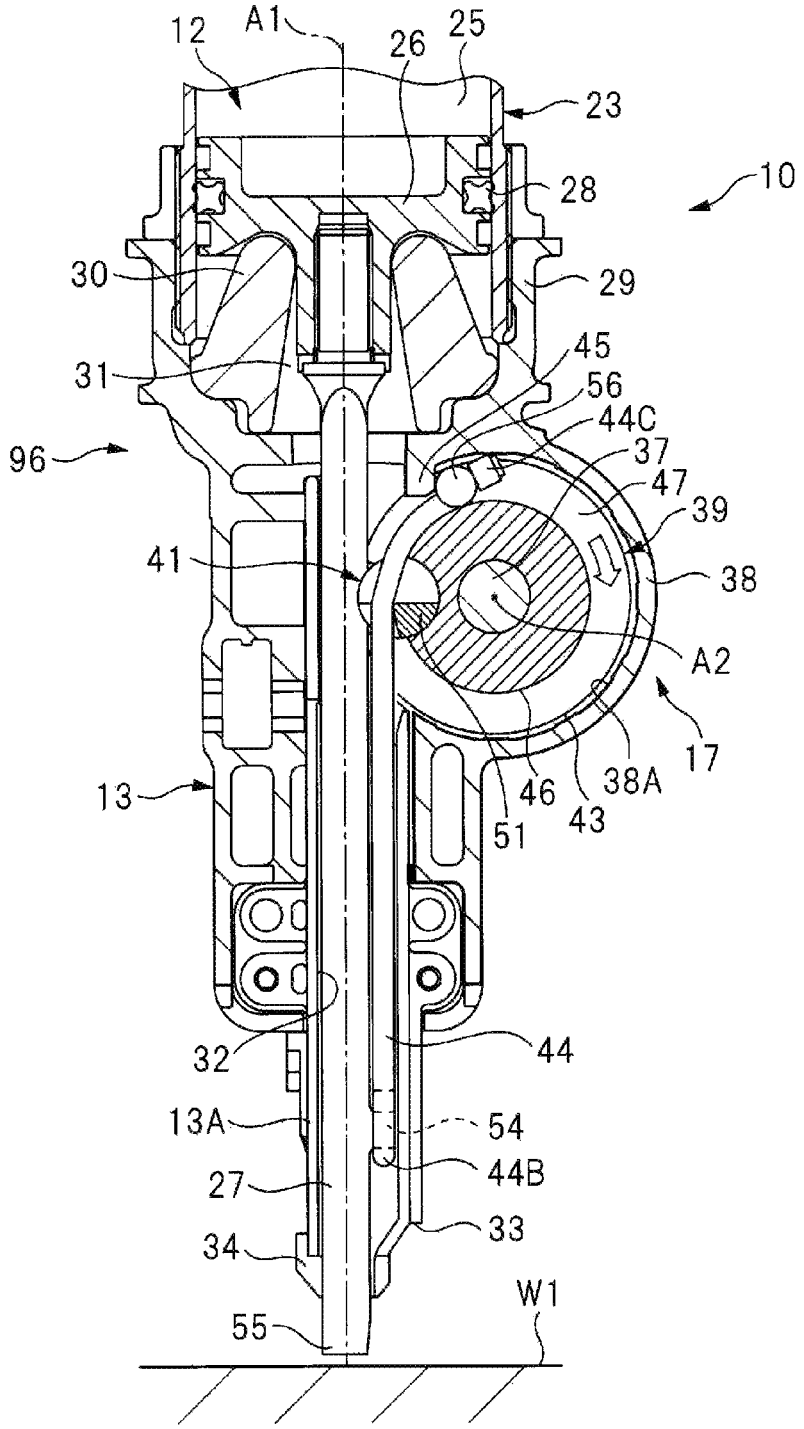
FIG. 2A is a left side cross-sectional view of a state in which a striking part according to Embodiment 1 of the driving tool is disposed at a bottom dead center.

The striking part 12 is disposed throughout the inside and the outside of the housing 11. As shown in FIG. 2A, the striking part 12 has a piston 26 and a driver blade 27. The piston 26 is reciprocable in the cylinder 23 in the centerline A1 direction. A seal member 28 is attached to an outer circumferential surface of the piston 26. When the striking part 12 is operated in the centerline A1 direction, the piston 26 and the seal member 28 slide with respect to an inner circumferential surface of the cylinder 23.

The nose 96 shown in FIG. 1 has an ejection part 13 and a support part 29. In the embodiment, the nose 96 is configured by integrating the ejection part 13 and the support part 29. The nose 96 is formed of a metal as an example. The ejection part 13 and the support part 29 are arranged in the centerline A1 direction. The support part 29 is disposed between the ejection part 13 and the head cover 20 in the centerline A1 direction. The support part 29 has a cylindrical shape, and the support part 29 is provided in the housing 11. A bumper 30 is supported by the support part 29. The bumper 30 may be formed of a synthetic rubber or a silicon rubber. The bumper 30 has an annular shape, and the bumper 30 has a guide hole 31. The guide hole 31 is provided about the centerline A1.

Figure 2B:
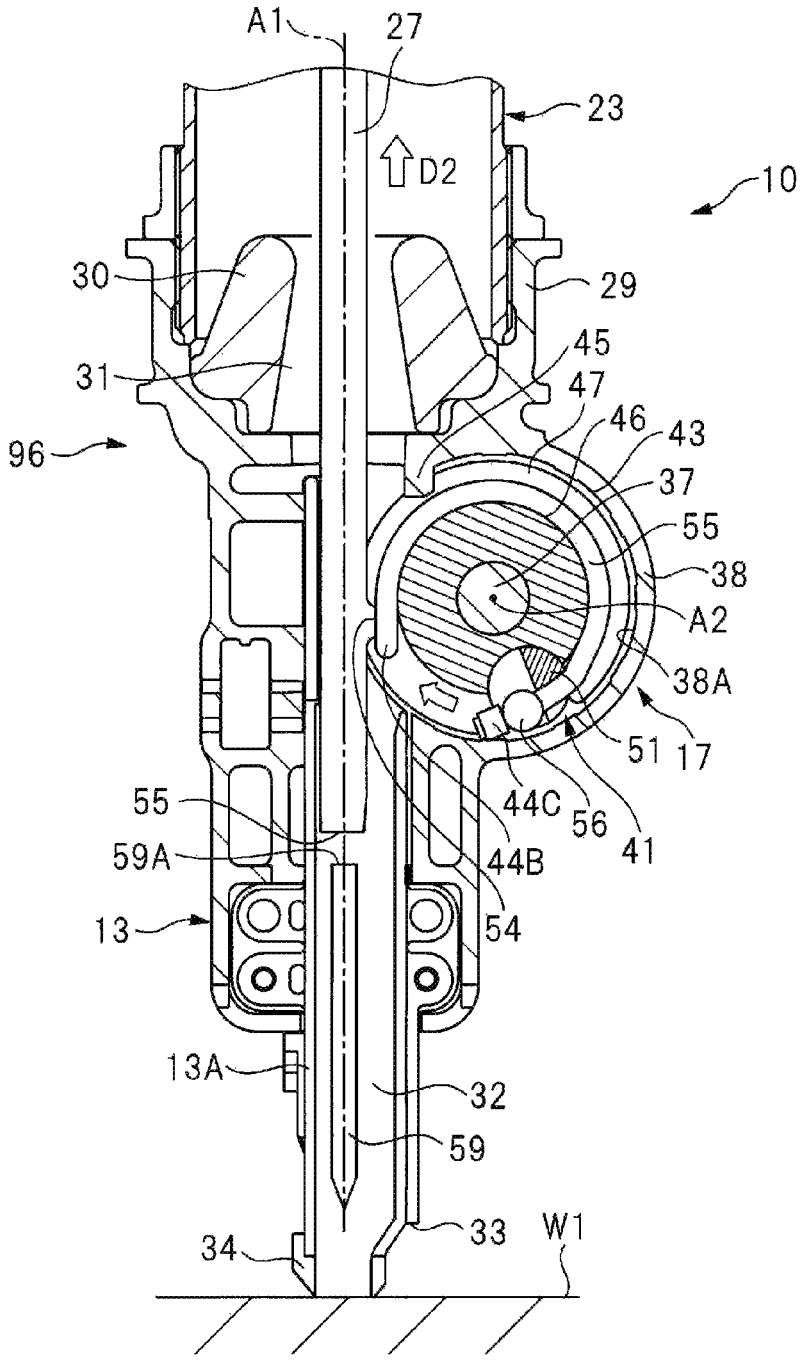
FIG. 2B is a left side cross-sectional view of a state in which the striking part according to Embodiment 1 of the driving tool is disposed at a top dead center.
Figure 2C:
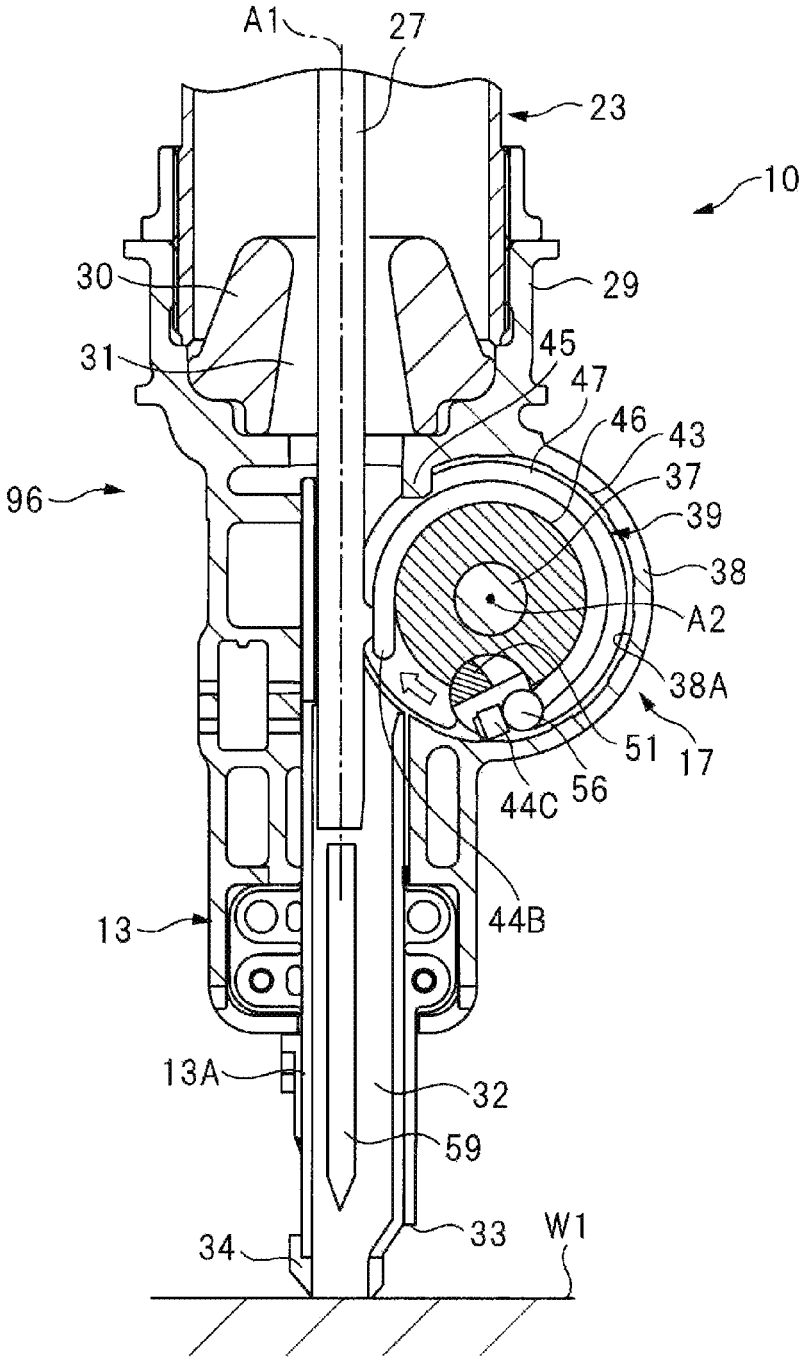
FIG. 2C is a left side cross-sectional view immediately before the striking part according to Embodiment 1 of the driving tool is operated from the top dead center toward the bottom dead center.

The ejection part 13 has a blade guide 13A shown in FIGS. 2A, 2B and 2C, and the blade guide 13A forms an ejecting path 32. The ejecting path 32 is a passage or a guide hole formed in the centerline A1 direction. The driver blade 27 is movable through the ejecting path 32 in the centerline A1 direction. The blade guide 13A prevents the driver blade 27 from moving in a direction crossing the centerline A1. The blade guide 13A has a tip 33. The tip 33 is a place of the blade guide 13A furthest from the support part 29 in the centerline A1 direction. A push lever 34 is attached to the ejection part 13. The push lever 34 is movable with respect to the ejection part 13 within a predetermined range in the centerline A1 direction.

The striking part 12 is operated in the centerline A1 direction between a top dead center shown by a broken line and a bottom dead center shown by a solid line in FIG. 1. The top dead center of the striking part 12 corresponds to a position where the piston 26 is furthest from the bumper 30. The bottom dead center of the striking part 12 corresponds to a position where the piston 26 is in contact with the bumper 30. An operating direction in which the striking part 12 approaches the bumper 30 may be defined as a first direction D1. An operating direction in which the striking part 12 is separated from the bumper 30 may be defined as a second direction D2. The first direction D1 and the second direction D2 are opposite to each other.

The power supply unit 14 shown in FIG. 1 can be attached to and detached from the connecting part 22. The power supply unit 14 has an accommodating case, and a plurality of battery cells accommodated in the accommodating case. A secondary battery may be used as the battery cell as an example. The electric motor 15 is disposed in the motor case 21. The electric motor 15 has a rotor 35 and a stator 36. Forward rotation and reverse rotation of the rotor 35 of the electric motor 15 are possible.

A gear case 57 is provided in the motor case 21. The gear case 57 is formed of a metal as an example. The speed reducer 16 is provided in the gear case 57. An input element of the speed reducer 16 is connected to the rotor 35, and an output element of the speed reducer 16 is connected to a rotating shaft 37. The electric motor 15, the speed reducer 16 and the rotating shaft 37 are disposed concentrically about a centerline A2. As shown in FIG. 2A, the centerline A1 and the centerline A2 are disposed at an interval while the centerline A1 and the centerline A2 do not cross each other when seen in a side view perpendicular to the centerline A2.

A rotation regulating mechanism 97 is provided in the gear case 57. The rotation regulating mechanism 97 allows a wheel 39 to rotate clockwise in FIG. 2A using a rotating force when the electric motor 15 rotates forward. The rotation regulating mechanism 97 prevents the wheel 39 from rotating counterclockwise.

Figure 3:
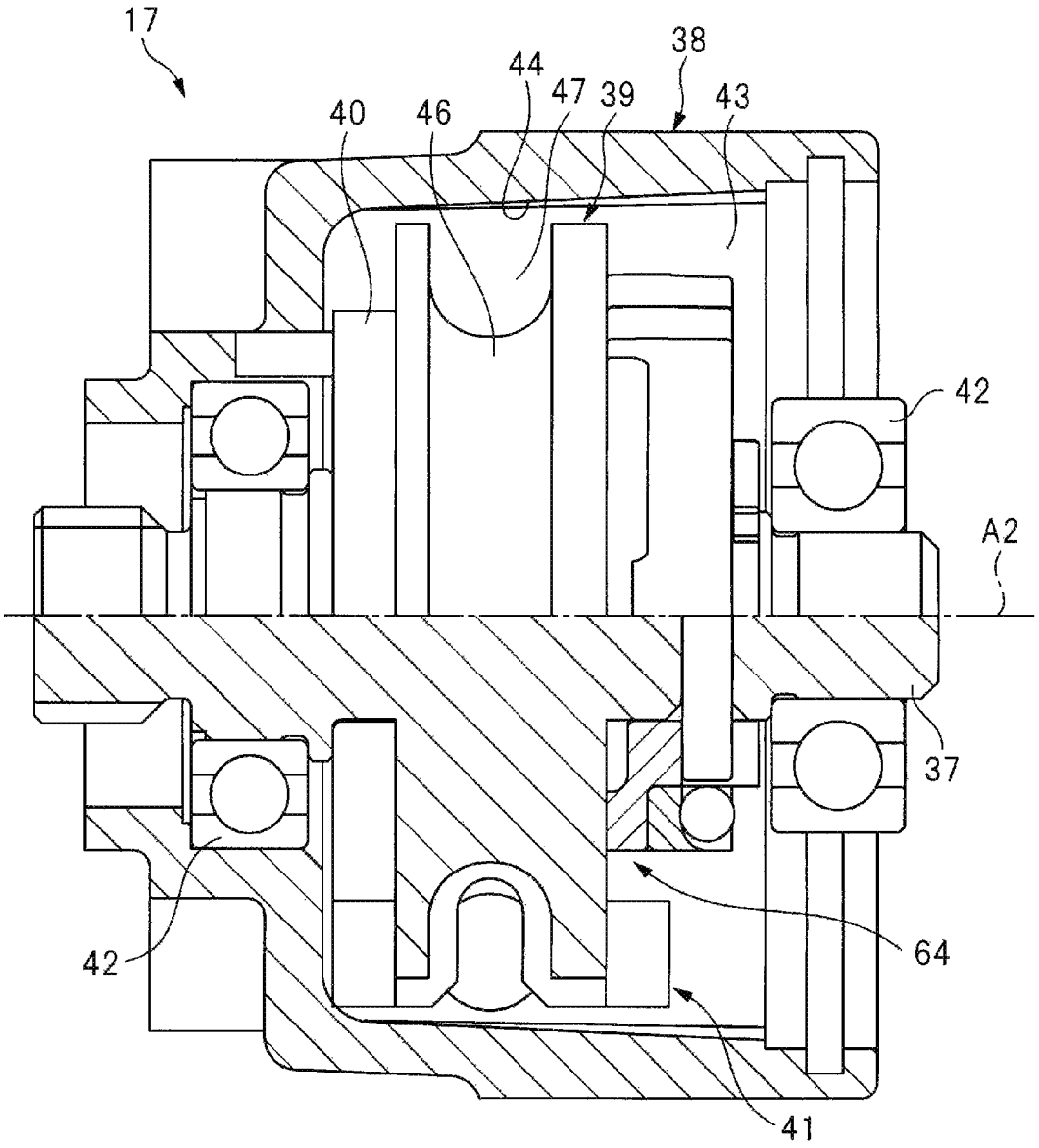
FIG. 3 is a front cross-sectional view of a converting part provided in Embodiment 1 of the driving tool.
Figure 4A:
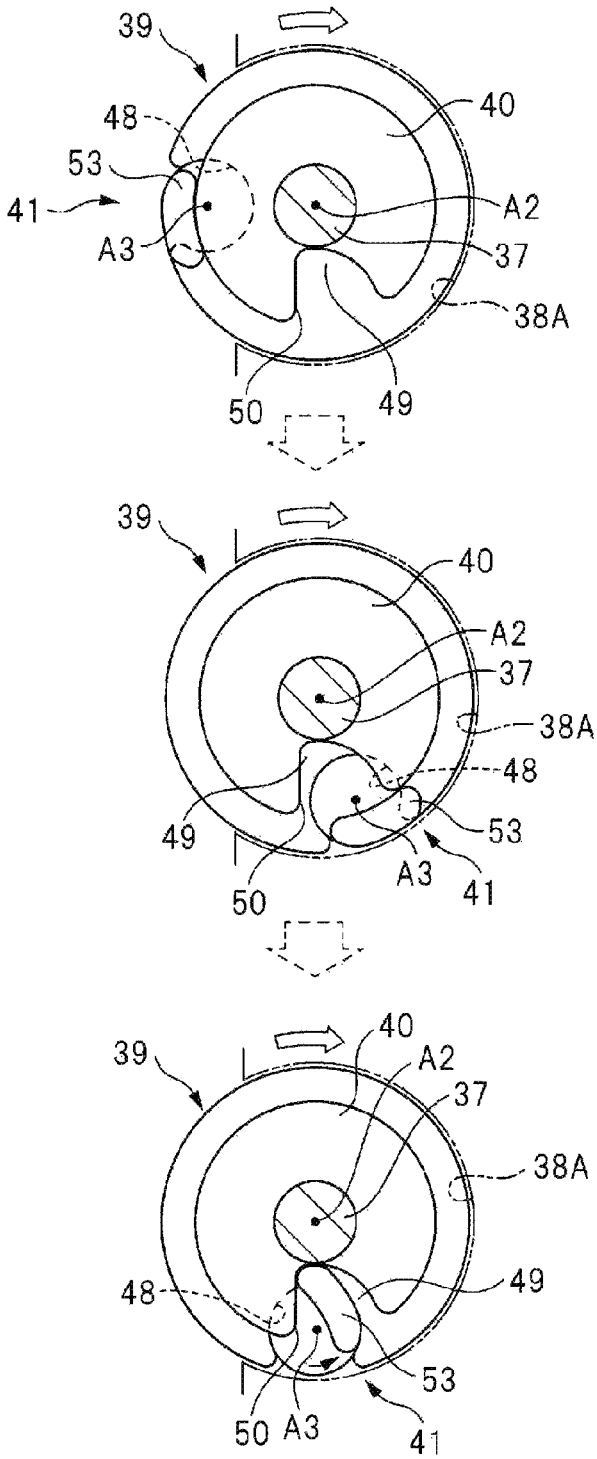
FIG. 4A is a left side view showing an operation state of the converting part.

The converting part 17 is disposed in the housing 11. The converting part 17 is disposed in a region between the bumper 30 and the tip 33 of the blade guide 13A in the centerline A1 direction. The converting part 17 converts a rotating force of the rotating shaft 37 into a force for operating the driver blade 27 in the centerline A1 direction. As shown in FIGS. 3 and 4A, the converting part 17 has a casing 38, the wheel 39, a hook guide 40 and a hook 41. The casing 38 is formed of a metal as an example, and the casing 38 is integrated with the nose 96. The casing 38 rotatably supports the rotating shaft 37 via a bearing 42. A cross-sectional shape of the casing 38 is an arc shape when seen in a plan view perpendicular to the centerline A1 of the rotating shaft 37. The casing 38 forms an accommodating chamber 43. The accommodating chamber 43 is connected to the ejecting path 32. An inner circumferential surface 38A of the casing 38 has an arc shape about the centerline A2. A stopper 45 is provided to protrude inward from the inner circumferential surface 38A.

The wheel 39 is fixed to the rotating shaft 37. The wheel 39 is formed of a metal or a synthetic resin as an example, and disposed in the accommodating chamber 43. The wheel 39 has a winding groove 46 formed throughout the circumference in the rotating direction. A passage 47 is formed between the winding groove 46 and the inner circumferential surface 38A. The passage 47 is disposed in an arc shape about the centerline A2. The wheel 39 has a holding groove 48 shown in FIG. 4A. The holding groove 48 is provided in a part of the wheel 39 in the rotating direction. An inner circumferential surface of the holding groove 48 has an arc shape when seen in a plan view perpendicular to the centerline A2.

The hook guide 40 is disposed in the accommodating chamber 43. The hook guide 40 is a metal plate as an example. The hook guide 40 is attached not to rotate with respect to the casing 38. The hook guide 40 has a concave part 49 that opens in the outer circumferential surface, and a protrusion 50 in which the concave part 49 is formed.

Figure 5:
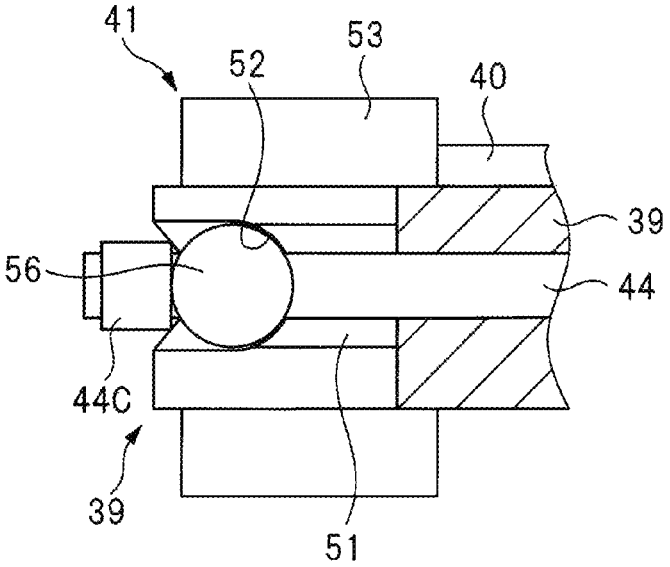
FIG. 5 is an enlarged view showing a major part of the converting part.
Figure 6:
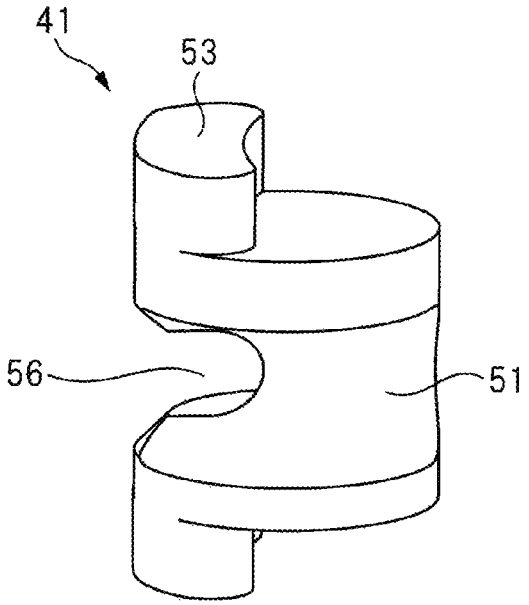
FIG. 6 is a perspective view showing parts of the converting part.

The hook 41 is formed of a metal as an example, and disposed in the holding groove 48. A shape of the outer circumferential surface of the hook 41 is a circular shape. As shown in FIG. 4A, the hook 41 is autorotatable in the holding groove 48 about a centerline A3. The centerline A3 is parallel to the centerline A2. As shown in FIGS. 5 and 6, the hook 41 has an engagement part 51, a groove 52 and a guide part 53. The guide part 53 is disposed eccentrically from the centerline A3 as shown in FIG. 4A, and has an arc shape when seen in a plan view perpendicular to the centerline A2.

As shown in FIG. 2A, an attachment part 54 is provided on the driver blade 27. The attachment part 54 is provided between a tip 55 and the piston 26 in a centerline direction of the driver blade 27. The tip 55 is a place in the driver blade 27 furthest from the piston 26 in the centerline A1 direction. In a state in which the piston 26 is in contact with the bumper 30, the attachment part 54 is disposed between the casing 38 and the tip 33.

A wire material 44 is disposed throughout the ejecting path 32 and the accommodating chamber 43. The wire material 44 is fabricated by twisting a plurality of single materials together as an example. The single material is formed of a synthetic resin or a metal. Alternatively, the single material may be obtained by assembling a plurality of materials. For example, there are mixed resin ropes such as a high strength resin core member coated with a high wear-resistant resin surface material, metal wire materials coated with a resin, and the like. The wire material 44 may be any one of a wire, a cable and a rope. The wire material 44 has a predetermined tensile strength with respect to a load in a lengthwise direction, and predetermined flexibility in the lengthwise direction. A hanger ring 44B is provided on a first end portion of the wire material 44 in the lengthwise direction, and the hanger ring 44B is hung on the attachment part 54. An engagement part 56 is attached to a second end portion 44C of the wire material 44 in the lengthwise direction. The engagement part 56 is a ball formed of a metal or a synthetic resin as an example, and the wire material 44 passes through a through-hole of the ball. An outer diameter of the ball is larger than an outer diameter of the wire material 44. A part of the wire material 44 in the longitudinal direction is disposed in the accommodating chamber 43 regardless of the position of the driver blade 27 in the centerline A1 direction.

The stopper 45 includes the centerline A1 and is disposed between the driver blade 27 and the rotating shaft 37 when seen in a plan view perpendicular to the centerline A2. The stopper 45 is disposed between the support part 29 and the rotating shaft 37 in the centerline A1 direction. The driving part 63 is constituted by the electric motor 15, the speed reducer 16 and the converting part 17.

A rotation amount detecting part 64 is provided in the accommodating chamber 43. The rotation amount detecting part 64 is a Hall element configured to detect a rotation amount of the wheel 39.

A magazine 58 shown in FIG. 1 is supported by the nose 96 and the connecting part 22. The magazine 58 accommodates nails 59. The plurality of nails 59 are connected in a row and accommodated in the magazine 58. The magazine 58 has a feeder, and the feeder supplies the nails 59 in the magazine 58 to the ejecting path 32 one by one.

As shown in FIG. 1, a control part 60 is provided in the housing 11, for example, in the connecting part 22. The control part 60 has a microprocessor attached to the board. The microprocessor has an input/output processor, a control circuit, an arithmetic processing part and a storage part.

In addition, an inverter circuit electrically connected to the power supply unit 14 and the electric motor 15 is provided in the housing 11. The inverter circuit connects and disconnects the stator 36 of the electric motor 15 and the power supply unit 14. The inverter circuit includes a plurality of switching elements, and the plurality of switching elements can be solely turned on and off. The control part 60 controls rotation and stop of the electric motor 15, a rotating speed of the electric motor 15, and a rotating direction of the electric motor 15 by controlling the inverter circuit.

In addition, a trigger sensor 61, a push sensor and a position detection sensor are provided in the housing 11. The push sensor detects whether the push lever 34 is pressed against a driving target member W1, and outputs the detected signal. The trigger sensor 61 is provided in the handle 19, and the trigger sensor 61 outputs a signal according to an operating force applied to a trigger 62. The position detection sensor detects a position of the wheel 39 in the rotating direction, and outputs the detected signal. The signals of the trigger sensor 61, the push sensor and the position detection sensor are input to the control part 60.

Next, an example in which an operator uses the driving tool 10 will be described. The control part 60 stops the electric motor 15 when neither of application of an operating force to the trigger 62 and pressing of the push lever 34 against the driving target member W1 can be detected. When the electric motor 15 is stopped, the striking part 12 is stopped at a predetermined standby position. In the embodiment, a state in which the piston 26 is disposed at a bottom dead center shown in FIG. 2A will be described as a state in which the piston 26 is disposed at a standby position of the striking part 12.

When the striking part 12 is stopped at the standby position, the engagement part 56 comes into contact with the stopper 45. The engagement part 51 is disengaged from the engagement part 56. A part of the wire material 44 is disposed at the groove 52. In addition, as shown in an upper part of FIG. 4A, the guide part 53 comes in contact with the outer circumferential surface of the hook guide 40.

When the control part 60 detects that an operating force is applied to the trigger 62 and the push lever 34 is pressed against the driving target member W1, the electric motor 15 rotates forward. A rotating force of the electric motor 15 is transmitted to the wheel 39 via the speed reducer 16.

When the wheel 39 rotates clockwise as shown in FIG. 2A and the engagement part 51 is engaged with the engagement part 56, the wheel 39 starts winding of the wire material 44. When the wheel 39 starts winding of the wire material 44, the striking part 12 rises from the bottom dead center toward the top dead center. When the striking part 12 rises, the capacity of the pressure accumulator 25 is reduced, and the pressure of the pressure accumulator 25 rises.

When the wheel 39 winds up the wire material 44, a counterclockwise pulling force is applied to the wire material 44, and a counterclockwise rotating force is applied from the engagement part 56 to the hook 41 about the centerline A3. Here, since the guide part 53 is pressed against the outer circumferential surface of the hook guide 40 and the inner circumferential surface 38A, the hook 41 does not rotate about the centerline A3.

When the striking part 12 further rises according to rotation of the wheel 39, as shown in FIG. 2B, the tip 55 of the driver blade 27 is disposed between a head part 59A of the nail 59 and the support part 29 in the centerline A1 direction. In addition, as shown in a middle part of FIG. 4A, the hook 41 approaches the concave part 49 of the hook guide 40 in the rotating direction of the wheel 39.

Then, the guide part 53 reaches the outside of the concave part 49. Next, the hook 41 rotates counterclockwise about the centerline A3 by a predetermined angle as shown by a lower part of FIG. 4A due to the rotating force applied to the hook 41 from the engagement part 56. That is, a part of the guide part 53 enters the concave part 49. For this reason, as shown in FIG. 2C, the engagement part 51 is disengaged from the engagement part 56. The engagement part 51 and the wire material 44 move counterclockwise in the passage 47 as shown in FIG. 2C.

In addition, after a part of the guide part 53 enters the concave part 49, the protrusion 50 is pressed against the guide part 53 according to clockwise rotation of the wheel 39. For this reason, a clockwise rotating force of the centerline A3 is applied to the hook 41, and as shown in an upper part of FIG. 4A, the guide part 53 enters between the outer circumferential surface of the hook guide 40 and the inner circumferential surface 38A.

When the engagement part 51 is disengaged from the engagement part 56, the striking part 12 is operated in the first direction D1 by the pressure in the pressure accumulator 25. When the striking part 12 is operated in the first direction D1, the driver blade 27 strikes the nail 59 disposed in the ejecting path 32, and the nail 59 is driven to the driving target member W1. The push lever 34 is separated from the driving target member W1 by a reaction force generated as the driver blade 27 strikes the nail 59.

In addition, the piston 26 collides with the bumper 30 as shown in FIG. 2A, and the engagement part 56 comes in contact with the stopper 45 and stops. The control part 60 processes a signal from the position detection sensor, and the electric motor 15 stops before the hook 41 reaches the stopper 45 in the rotating direction of the wheel 39.

In Embodiment 1 of the driving tool 10, the entire wire material 44 and the driving part 63 are disposed outside the pressure accumulator 25. Accordingly, an increase in size of the driving tool 10 can be minimized.

Further, the entire wire material 44 and the driving part 63 are disposed outside a region C1 and outside a region C2. The region C1 is a range in which a part of the pressure accumulator 25 is formed in the cylinder 23 in the radial direction of the cylinder 23. The region C2 is a range in which the piston 26 slides with respect to the cylinder 23 in the operating direction of the striking part 12. Accordingly, an increase in size of the cylinder 23 in the radial direction can be minimized by the driving tool 10.

The entire wire material 44 and the driving part 63 are provided between the bumper 30 and the tip 33 of the blade guide 13A in the operating direction of the striking part 12. That is, a disposition region of the ejection part 13 and a disposition region of the entire wire material 44 and the driving part 63 at least partially overlap each other in the centerline A1 direction. Accordingly, an increase in size of the driving tool 10 in the centerline A1 direction can be minimized.

Further, even when the striking part 12 is operated in either the first direction D1 or the second direction D2, the wire material 44 and the engagement part 56 pass through the passage 47. Accordingly, an increase in size of the converting part 17 can be minimized.

Further, it is not necessary to provide an engagement part such as a rack or the like on the driver blade 27. Accordingly, a shape and a structure of the driver blade 27 can be simplified, and an increase in weight of the driver blade 27 can be minimized. In addition, since the rack is not provided on the driver blade 27, reduction in opening diameter of the guide hole 31 of the bumper 30, reduction in outer diameter of the bumper 30 and reduction in inner diameter of the support part 29 can be achieved. Accordingly, reduction in size of the entire driving tool 10 can be achieved. Reduction in rigidity of the bumper 30 can be minimized by reduction in opening diameter of the guide hole 31 of the bumper 30. In addition, since the engagement part 51 is not engaged with the driver blade 27, friction and deformation of the driver blade 27 can be minimized.

Further, maintenance of parts is finished by replacing the wire material 44, and finished without replacing the entire striking part 12 including the driver blade 27 or the wheel 39. Accordingly, a maintenance property is improved. Further, since the wire material 44 is disposed outside the element that constitutes the pressure accumulator 25, sealability of the pressure accumulator 25 can be improved.

Further, since the engagement part 56 is separately provided on the end portion of the wire material 44, bending or damage of the wire material 44 itself can be minimized, and durability of the wire material 44 is improved.

A state in which the engagement part 56 and the engagement part 51 are engaged with each other can be securely fixed until the wheel 39 reaches a predetermined place in the rotating direction. Accordingly, since the position of the top dead center of the striking part 12 in the centerline A1 direction, i.e., the striking part 12, drives the nail 59, a variation in timing when the engagement part 51 is disengaged from the wire material 44 can be minimized.

Figure 4B:
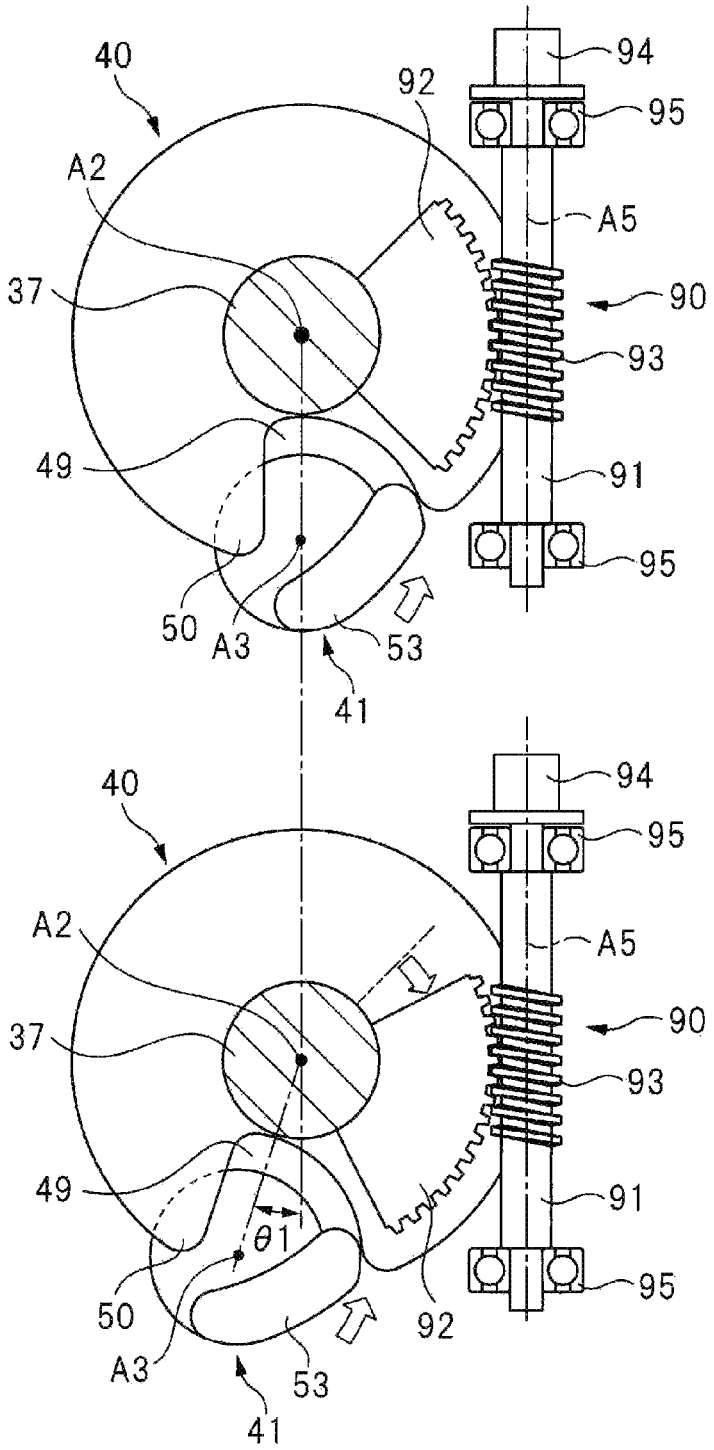
FIG. 4B is a view showing an adjustment mechanism that is able to be provided on the driving tool.

FIG. 4B is an example in which an adjustment mechanism 90 according to Embodiment 1 of the driving tool 10 is provided. The adjustment mechanism 90 is configured to adjust a timing when the engagement part 51 is disengaged from the engagement part 56 at the position of the striking part 12 operated in the second direction D2 in FIG. 2B.

The adjustment mechanism 90 has an adjustment shaft 91 and a sector gear 92. A worm 93 is formed on an outer circumferential surface of the adjustment shaft 91, and the worm 93 is meshed with the sector gear 92. The adjustment shaft 91 has a knob 94. The adjustment shaft 91 is supported by a bearing 95 rotatably about a centerline A5. The bearing 95 is supported by the casing 38. The knob 94 is exposed at the outside of the housing 11. The sector gear 92 is fixed to the hook guide 40. The hook guide 40 can be operated and stopped within a range of a predetermined angle with respect to the casing 38 about the centerline A2.

When the operator rotates the knob 94 with his/her finger, the hook guide 40 rotates about the centerline A2. When the hook guide 40 shown in the upper part of FIG. 4B is rotated clockwise and the hook guide 40 is stopped at the position shown in the lower part of FIG. 4B, the timing when the engagement part 51 is disengaged from the engagement part 56 at the position of the striking part 12 can be changed at an angle θ1 of the wheel 39 in the rotating direction. That is, when the adjustment mechanism 90 is operated, a top dead center of the striking part 12 can be changed.

Embodiment 2

Next, another example of the converting part 17 that can be used in the driving tool 10 will be described with reference to FIGS. 7A, 7B and 7C. The wheel 39 has two ribs 65 and 66 that form the winding groove 46. The ribs 65 and 66 are provided at an interval in the centerline A2 direction. As shown in FIG. 8, the ribs 65 and 66 are provided throughout the circumference of the wheel 39. An engagement part 65A is provided on the rib 65, and an engagement part 66A is provided on the rib 66. The engagement parts 65A and 66A are disposed at the same position in the rotating direction of the wheel 39. An interval between the engagement part 65A and the engagement part 66A in the centerline A2 direction is smaller than an interval at another place in the winding groove 46. The interval is smaller than an interval at another place between the rib 65 and the rib 66.

In addition, the casing 38 has a release claw 67 and a retracting part 68. The release claw 67 protrudes from an inner surface of the casing 38 toward the accommodating chamber 43. The stopper 45 and the release claw 67 are disposed between the rib 65 and the rib 66. When the wheel 39 is rotated, the stopper 45 and the release claw 67 pass between the engagement part 65A and the engagement part 66A.

In addition, the release claw 67 is disposed downstream from the inner circumferential surface 38A in the rotating direction of the wheel 39. The retracting part 68 is a concave part connected to the inner circumferential surface 38A. A part of the retracting part 68 is disposed at a side outward from the outer circumferential surface of the wheel 39 in the radial direction of the wheel 39. The retracting part 68 is provided between the release claw 67 and the inner circumferential surface 38A in the rotating direction of the wheel 39.

Actions of Embodiment 2 of the driving tool 10 will be described. When the striking part 12 is disposed at the bottom dead center as show in FIG. 7A, the engagement part 56 is in contact with the stopper 45.

Figure 7A:
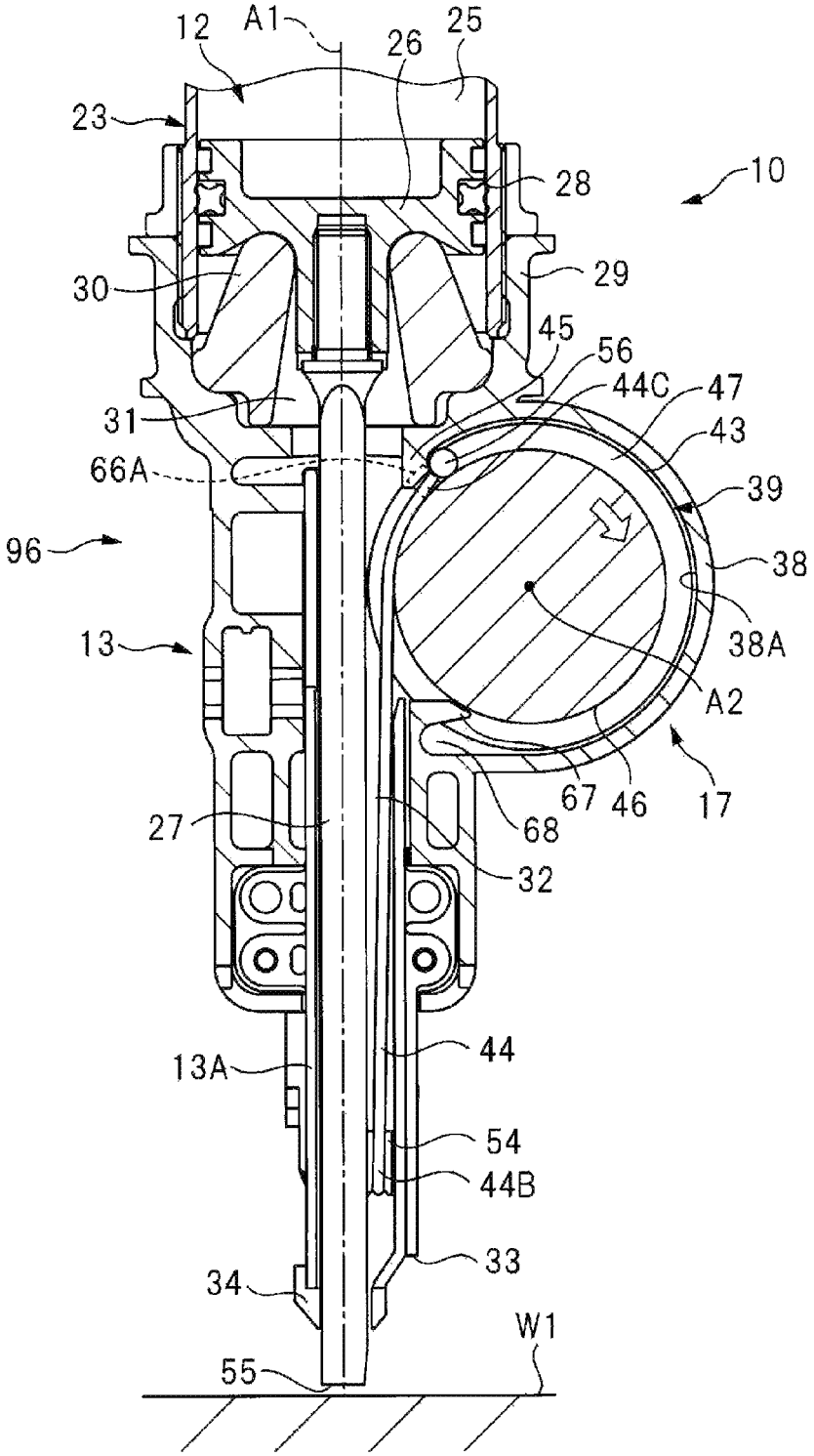
FIG. 7A is a left side cross-sectional view of a state in which a striking part according to Embodiment 2 of the driving tool is disposed at a bottom dead center.
Figure 7B:
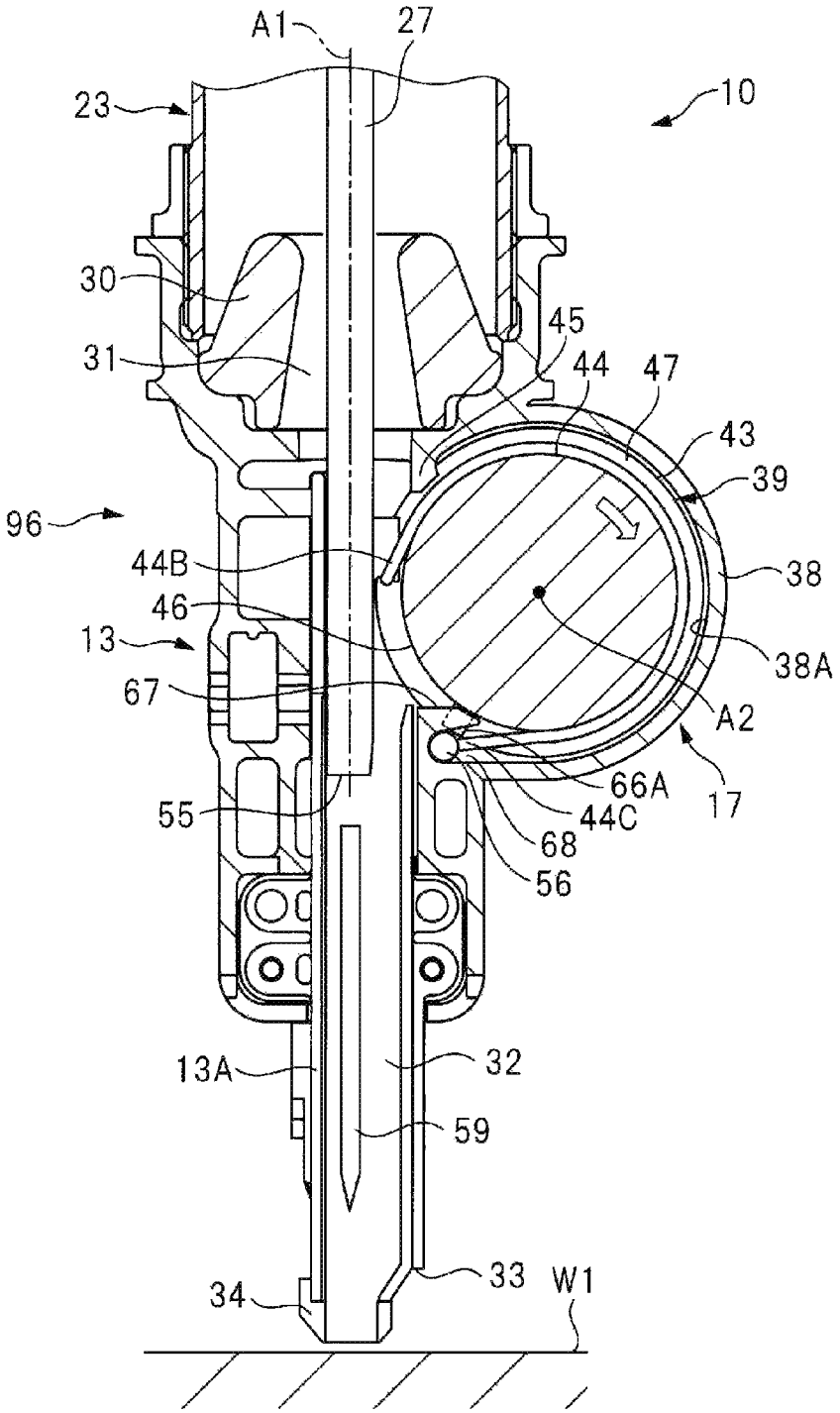
FIG. 7B is a left side cross-sectional view of a state in which the striking part according to Embodiment 2 of the driving tool is disposed at a top dead center.
Figure 7C:
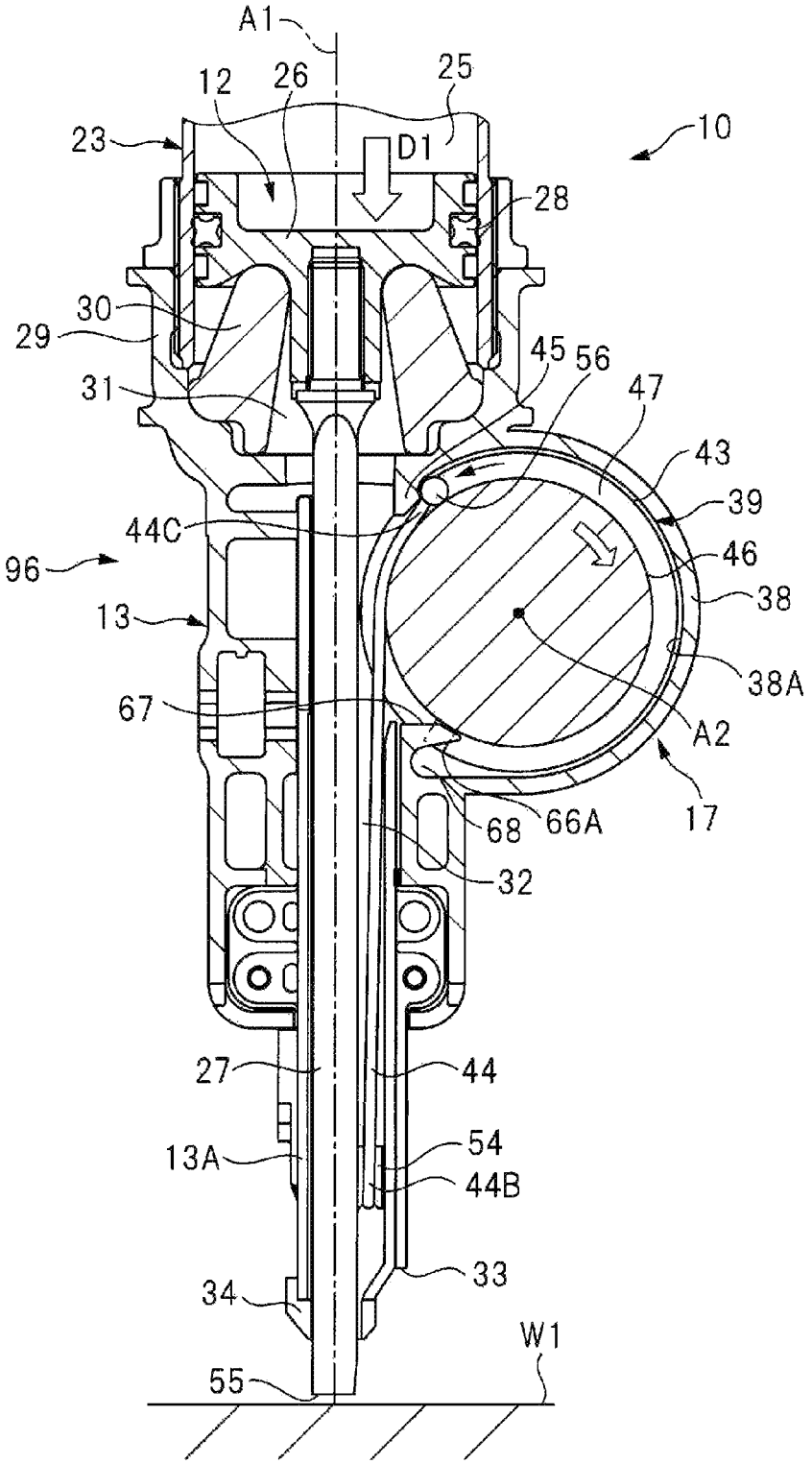
FIG. 7C is a left side cross-sectional view immediately before the striking part according to Embodiment 2 of the driving tool is operated from the top dead center toward the bottom dead center.
Figure 8:
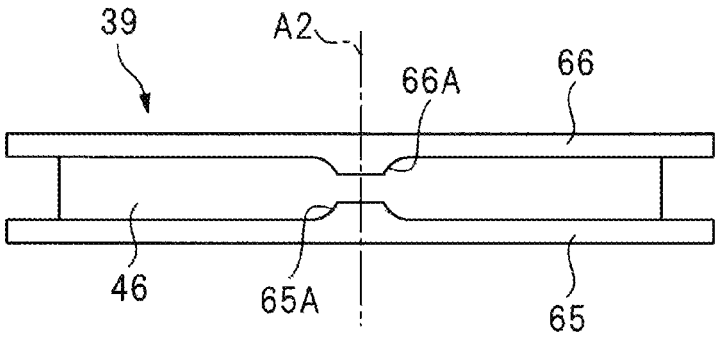
FIG. 8 is a plan view of a wheel used in Embodiment 2 of the driving tool.

The wire material 44 is pulled when the wheel 39 is rotated clockwise in FIG. 7A and the engagement parts 65A and 66A are engaged with the engagement part 56, and the wheel 39 winds the wire material 44. The engagement part 56 and the wire material 44 are disposed in a winding groove 46 and pass through the passage 47. When the wheel 39 winds the wire material 44, the striking part 12 is operated toward the top dead center. When the striking part 12 approaches the top dead center, the release claw 67 is engaged with the engagement part 56. The engagement part 56 moves along the release claw 67, and the engagement part 56 enters the retracting part 68. For this reason, as shown in FIG. 7B, the engagement part 56 is disengaged from the engagement parts 65A and 66A. Then, the striking part 12 is operated from the top dead center toward the bottom dead center by the pressure in the pressure accumulator 25, and the driver blade 27 strikes the nail 59. In addition, the wire material 44 and the engagement part 56 are pulled by the driver blade 27 and move through the passage 47 counterclockwise. When the striking part 12 reaches the bottom dead center as shown in FIG. 7C, the engagement part 56 comes into contact with the stopper 45 and the wire material 44 is stopped.

In Embodiment 2 of the driving tool 10, the same effects as in Embodiment 1 of the driving tool 10 can be obtained. In addition, the engagement part 66A provided on the wheel 39 has a simple configuration without being operated with respect to the wheel 39. Accordingly, a product main body can be reduced in size and weight.

Embodiment 3

Next, another example of the converting part 17 that can be used in the driving tool 10 will be described with reference to FIGS. 9A, 9B, 10 and 11. The converting part 17 has a wheel 69, a lifter guide 70, a lifter 71, a casing 72, and pulleys 73 and 74. The casing 72 is integrated with the ejection part 13. The casing 72 has an accommodating chamber 83, and the accommodating chamber 83 is connected to the ejecting path 32.

The wheel 69 is disposed in the accommodating chamber 83. The wheel 69 is supported by the casing 72 to be rotatable about a centerline A4. A support shaft 75 of the wheel 69 has a bevel gear 76. A bevel gear 77 is provided on the rotating shaft 37, and the bevel gear 76 and the bevel gear 77 are meshed with each other. When the rotating shaft 37 is rotated by the rotating force of the electric motor 15, the wheel 69 is rotated.

Figure 10:
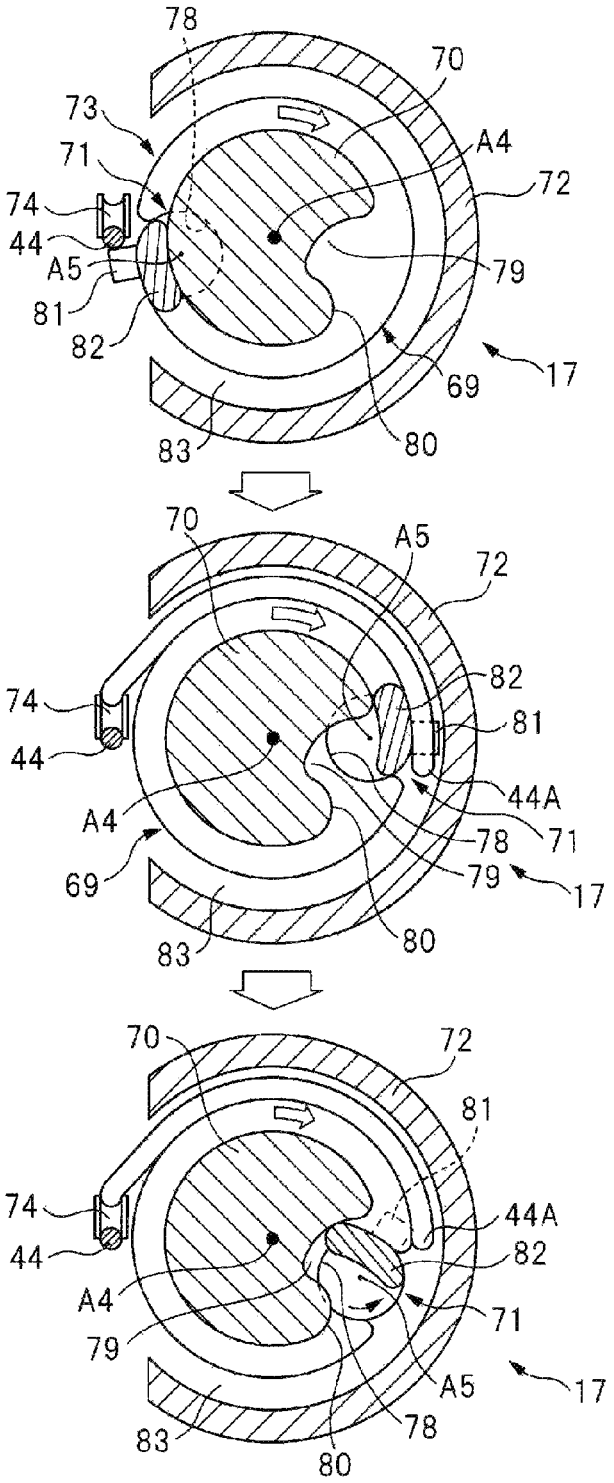
FIG. 10 is a bottom cross-sectional view of a converting part according to Embodiment 3 of the driving tool.

The wheel 69 has a holding groove 78 shown in FIG. 10. The holding groove 78 is provided in a part of the wheel 69 in the rotating direction. An inner circumferential surface of the holding groove 78 has an arc shape when seen in a bottom view perpendicular to the centerline A4.

The lifter guide 70 is fixed to the casing 72. The hook guide 40 is a metal plate. The lifter guide 70 has a concave part 79 that opens in the outer circumferential surface, and a protrusion 80 in which the concave part 79 is formed.

Figure 11:
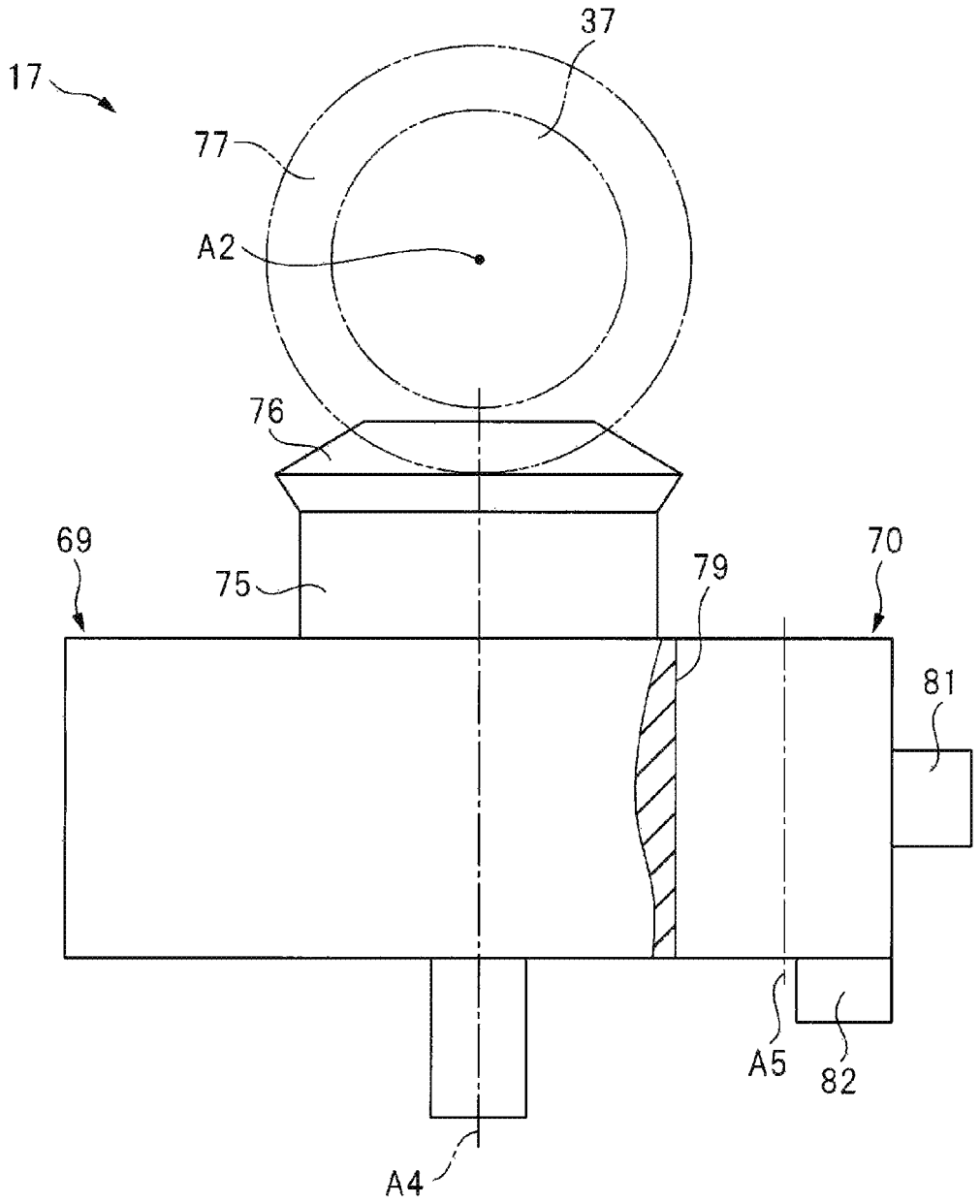
FIG. 11 is an enlarged view showing a part of the converting part according to Embodiment 3 of the driving tool.

The lifter 71 is a metal column. The lifter 71 is disposed in the holding groove 78. The lifter 71 is autorotatable in the holding groove 78 about the centerline A5. The centerline A5 is parallel to the centerlines A1 and A4. As shown in FIG. 11, the lifter 71 has an engagement part 81 and a guide part 82. The engagement part 81 protrudes from the outer circumferential surface of the lifter 71. The guide part 82 is disposed eccentrically from the centerline A5, and has an arc shape when seen in a bottom view perpendicular to the centerline A5.

The inner circumferential surface of the casing 72 has an arc shape when seen in a bottom view perpendicular to the centerline A4. The accommodating chamber 83 is formed between the outer circumferential surface of the wheel 69 and the inner circumferential surface of the casing 72. The pulleys 73 and 74 are disposed in the ejecting path 32. The pulleys 73 and 74 are respectively rotatable. The pulleys 73 and 74 are disposed at an interval in the centerline A1 direction. The pulley 74 is disposed between the attachment part 54 and the pulley 73 in the centerline A1 direction. The pulleys 73 and 74 are disposed between the driver blade 27 and the wheel 69 in a direction crossing the centerline A1. The engagement part 81 is disposed between the pulley 73 and the pulley 74 in the centerline A1 direction.

An attachment part 84 is provided on the support part 29. The attachment part 84 is disposed between the pulley 73 and the bumper 30 in the centerline A1 direction. A first end portion of the wire material 44 is connected to the attachment part 54, and a hanger ring 87 provided on a second end portion of the wire material 44 is hung on the attachment part 84. A place of the wire material 44 between the hanger ring 44B and the hanger ring 87 is hung on the pulleys 73 and 74.

Figure 9A:
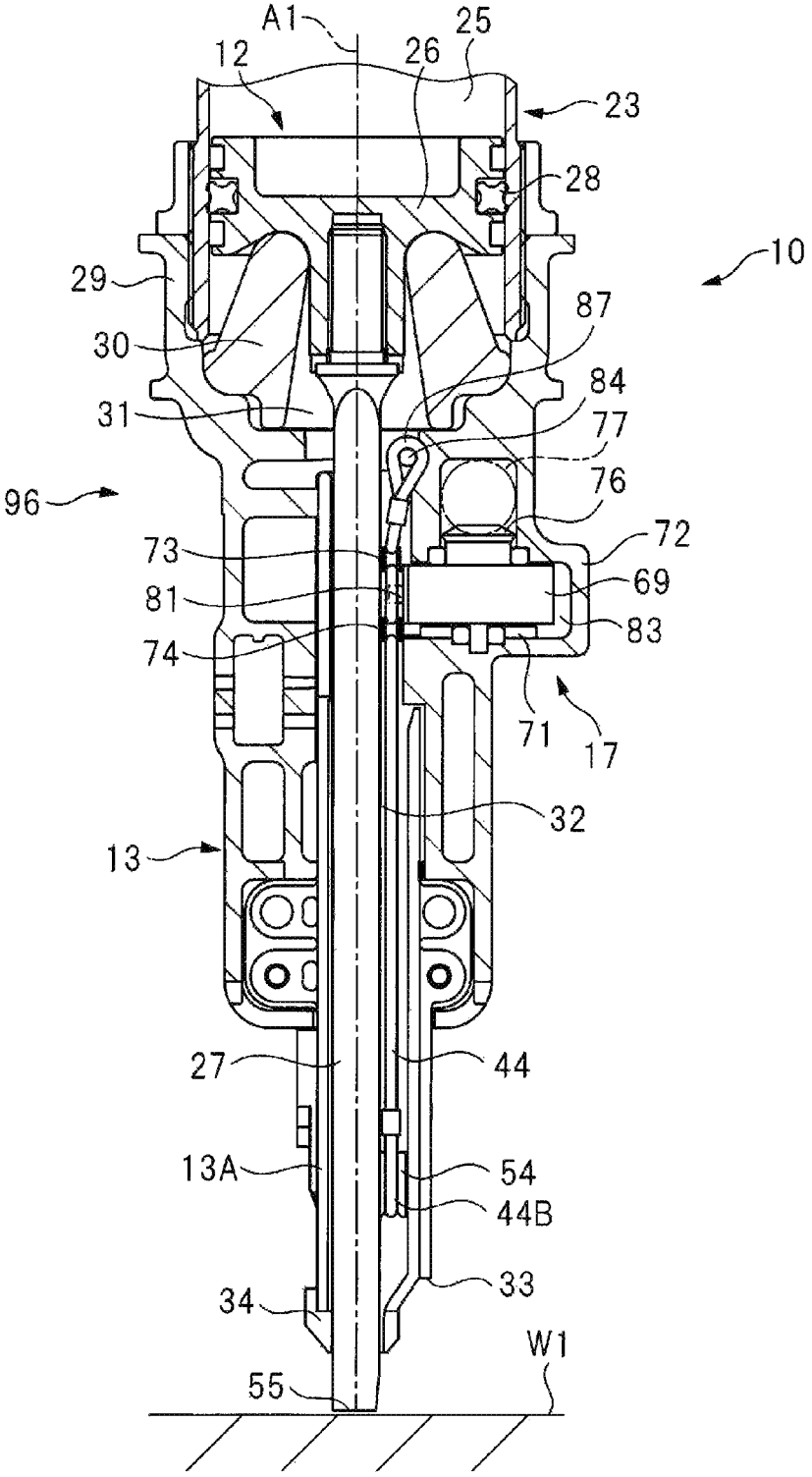
FIG. 9A is a left side cross-sectional view of a state in which a striking part according to Embodiment 3 of the driving tool is disposed at a bottom dead center.

Next, actions of Embodiment 3 of the driving tool 10 will be described. As shown in FIG. 9A, when the striking part 12 is disposed at the bottom dead center and the wheel 69 is stopped, as shown in an upper part of FIG. 10, the engagement part 81 comes into contact with the wire material 44 and is stopped in the ejecting path 32. The wire material 44 has a substantially linear shape, and the wheel 69 is separated from the wire material 44. In addition, the guide part 82 is in contact with the outer circumferential surface of the lifter guide 70.

When the wheel 69 is rotated clockwise as shown in FIG. 10, the engagement part 81 is engaged with a place 44A of the wire material 44 disposed in the middle of the space between the pulley 74 and the pulley 74, and pulls the wire material 44. As a result, the wheel 69 winds the wire material 44. The wire material 44 and the engagement part 81 pass through the accommodating chamber 83. When the wheel 69 winds the wire material 44, the striking part 12 is raised from the bottom dead center toward the top dead center, and the pressure of the pressure accumulator 25 is increased.

When the wheel 69 winds the wire material 44, a counterclockwise pulling force in FIG. 10 is applied to the wire material 44, and a counterclockwise rotating force is applied to the lifter 71 about the centerline A5. Here, since the guide part 82 is pressed against the outer circumferential surface of the lifter guide 70, the lifter 71 is not rotated about the centerline A5.

Figure 9B:
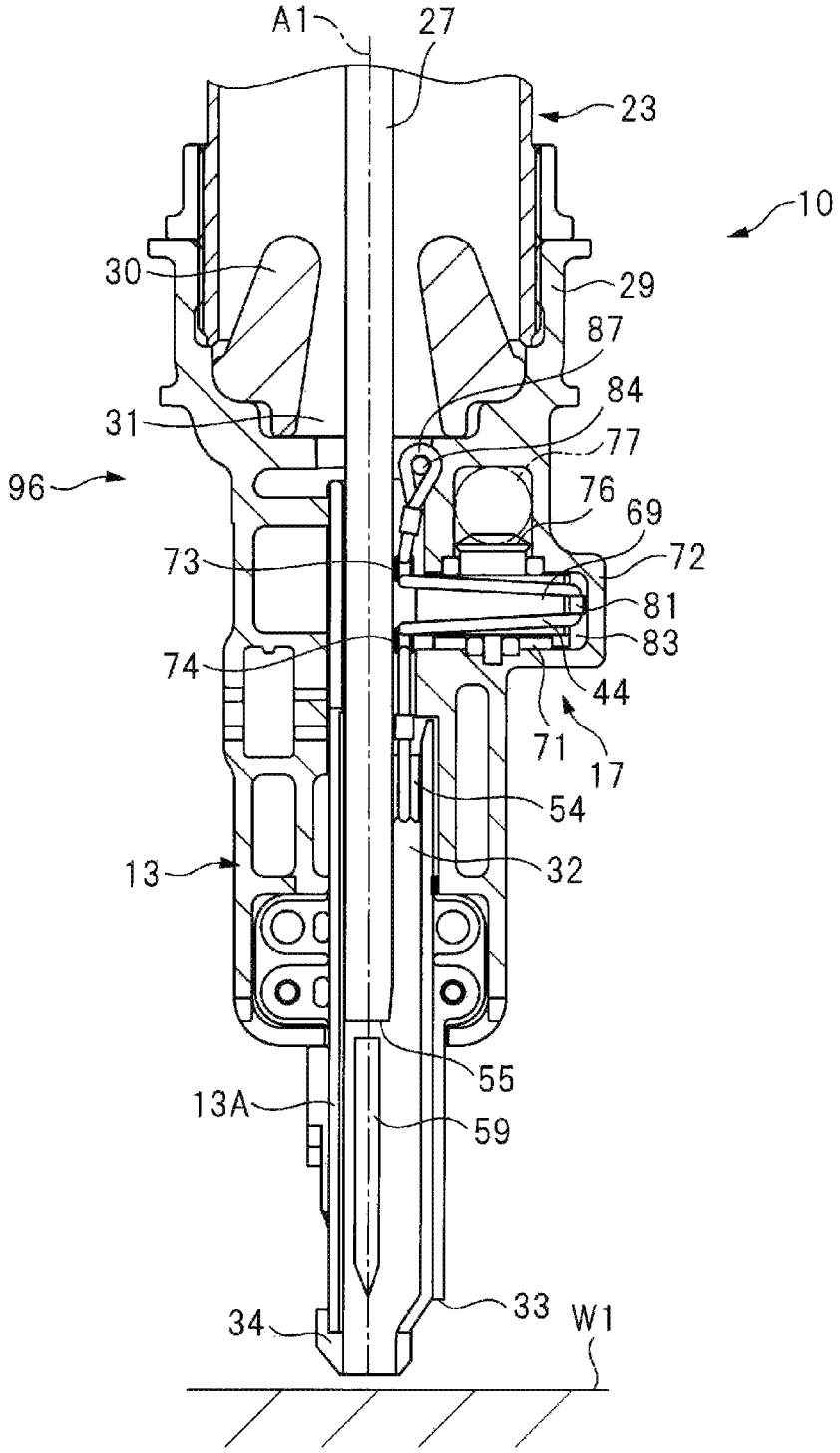
FIG. 9B is a left side cross-sectional view of a state in which the striking part according to Embodiment 3 of the driving tool is disposed at a top dead center.

When the striking part 12 is further raised according to rotation of the wheel 69, as shown in a middle part of FIGS. 9B and 10, the engagement part 81 reaches a position furthest from the pulleys 73 and 74. In addition, the lifter 71 approaches the concave part 79 in the rotating direction of the wheel 69.

Then, when the guide part 82 reaches outside the concave part 79, the lifter 71 is rotated counterclockwise by a predetermined angle about the centerline A5 as shown in a lower part of FIG. 10 by the rotating force applied from the engagement part 81 to the lifter 71. That is, a part of the guide part 82 enters the concave part 79. For this reason, the engagement part 81 is disengaged from the place 44A of the wire material 44. The wire material 44 moves counterclockwise in the accommodating chamber 83.

In addition, after a part of the guide part 82 enters the concave part 79, the protrusion 80 is pressed against the guide part 82 according to clockwise rotation of the wheel 69. For this reason, a clockwise rotating force is applied to the lifter 71 along the centerline A5, and the guide part 82 comes into contact with the outer circumferential surface of the lifter guide 70.

When the engagement part 81 is disengaged from the wire material 44, the striking part 12 is operated from the top dead center toward the bottom dead center by the pressure in the pressure accumulator 25, and the driver blade 27 strikes the nail 59. In addition, the piston 26 collides with the bumper 30 as shown in FIG. 9A. Further, when the wheel 69 is stopped, the engagement part 81 comes into contact with the wire material 44 and stops.

In Embodiment 3 of the driving tool 10, the same effects as in Embodiment 1 of the driving tool 10 can be obtained.

In addition, in Embodiment 3 of the driving tool 10, in comparison with Embodiment 1 of the driving tool 10, an intermediate position of the wire material 44 in the lengthwise direction is wound. For this reason, a winding amount of the wire material 44 with respect to a rotation amount of the wheel 69 is great, the driver blade 27 can be moved to a predetermined position by a small rotation amount of the wheel 69, and the pressure of the pressure accumulator 25 is increased. In other words, since the rotation amount of the wheel 69 required for winding the wire material 44 is small, a radius of the wheel 69 in the radial direction can be designed to be small, and the product main body can be reduced in size and weight. Here, the winding amount of the wire material 44 is almost twice as large as the rotation amount of the wheel 69.

Further, in Embodiment 3 of the driving tool 10, both ends of the wire material 44 are fixed to the driver blade 27 and the wheel 39, respectively. For this reason, the wire material 44 and the nose 96 do not need to have an engagement part, and the structure is simplified. Accordingly, the product main body can be reduced in size and weight.

Further, in Embodiment 3 of the driving tool 10, the adjustment mechanism 90 shown in FIG. 4B can also be provided.

Embodiment 4

Next, another example of the converting part 17 that can be used in the driving tool 10 will be described with reference to FIGS. 12 and 13. The wheel 39 has an attachment part 85 and an engagement part 86. The attachment part 85 is a shaft protruding from a surface of the wheel 39 in the centerline A2 direction. The hanger ring 87 is formed on an end portion of the wire material 44 in the lengthwise direction, and the hanger ring 87 is hung on the attachment part 85. Even when the wheel 39 is not rotated, the hanger ring 87 is not removed from the attachment part 85.

The engagement part 86 is disposed in an arc shape within a predetermined range about the centerline A2 in the rotating direction of the wheel 39. The range in which the engagement part 86 is disposed in the rotating direction of the wheel 39 is different from a place at which the attachment part 85 is disposed in the rotating direction of the wheel 39. The engagement part 86 has a support groove 88 and a notch 89. The support groove 88 is provided outside the engagement part 86 in the radial direction of the wheel 39. The notch 89 is continuously provided in the support groove 88 in the rotating direction of the wheel 39. The passage 47 is formed between the engagement part 86 and the inner circumferential surface 38A.

Next, actions of Embodiment 4 of the driving tool 10 will be described. As shown in FIGS. 12 and 13, when the striking part 12 is disposed at the bottom dead center and the wheel 39 is stopped, the wire material 44 is separated from the engagement part 86, and the wire material 44 is substantially linear.

Figure 12:
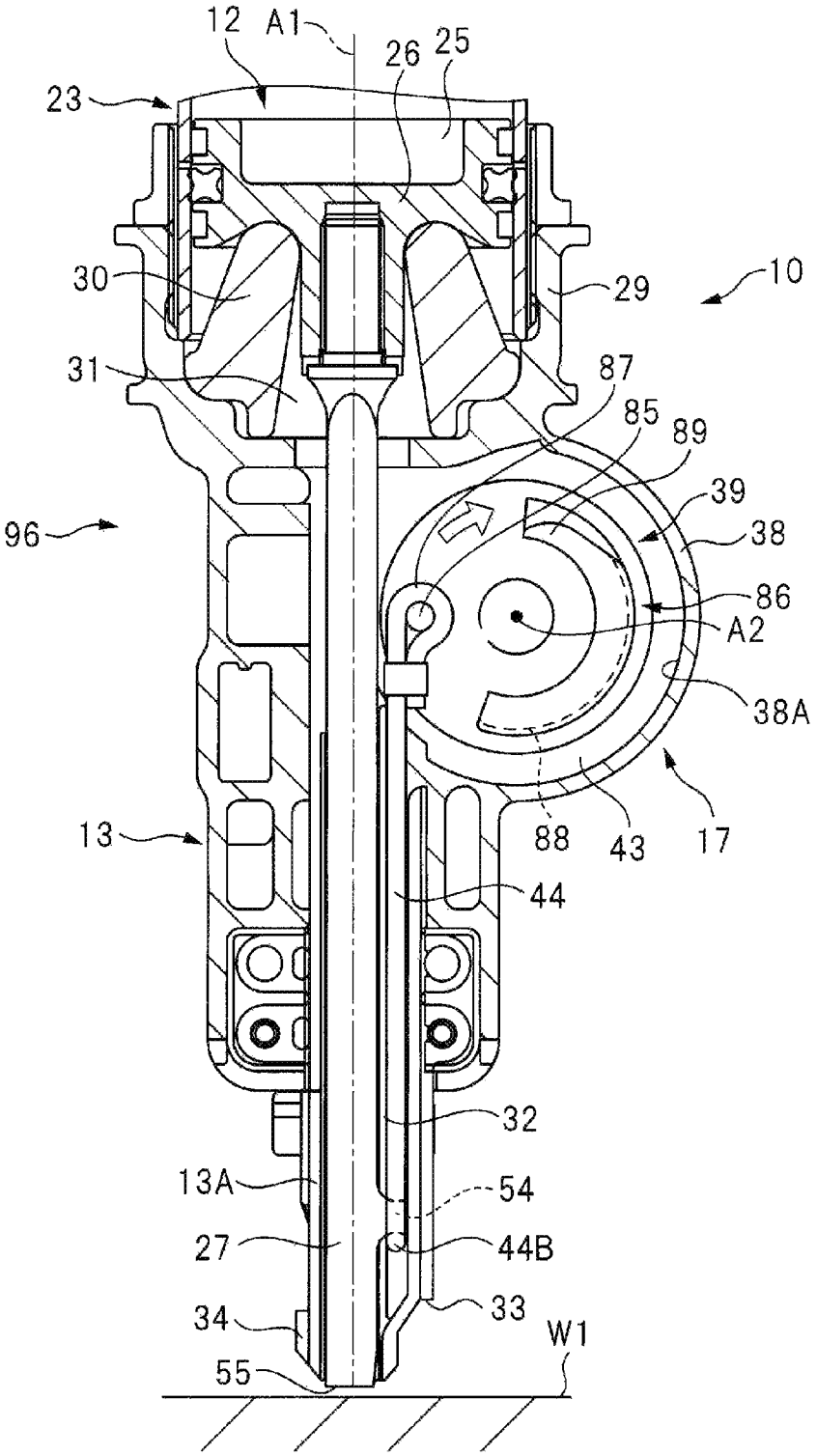
FIG. 12 is a left side cross-sectional view of a state in which a striking part according to Embodiment 4 of the driving tool is disposed at a bottom dead center.
Figure 13:
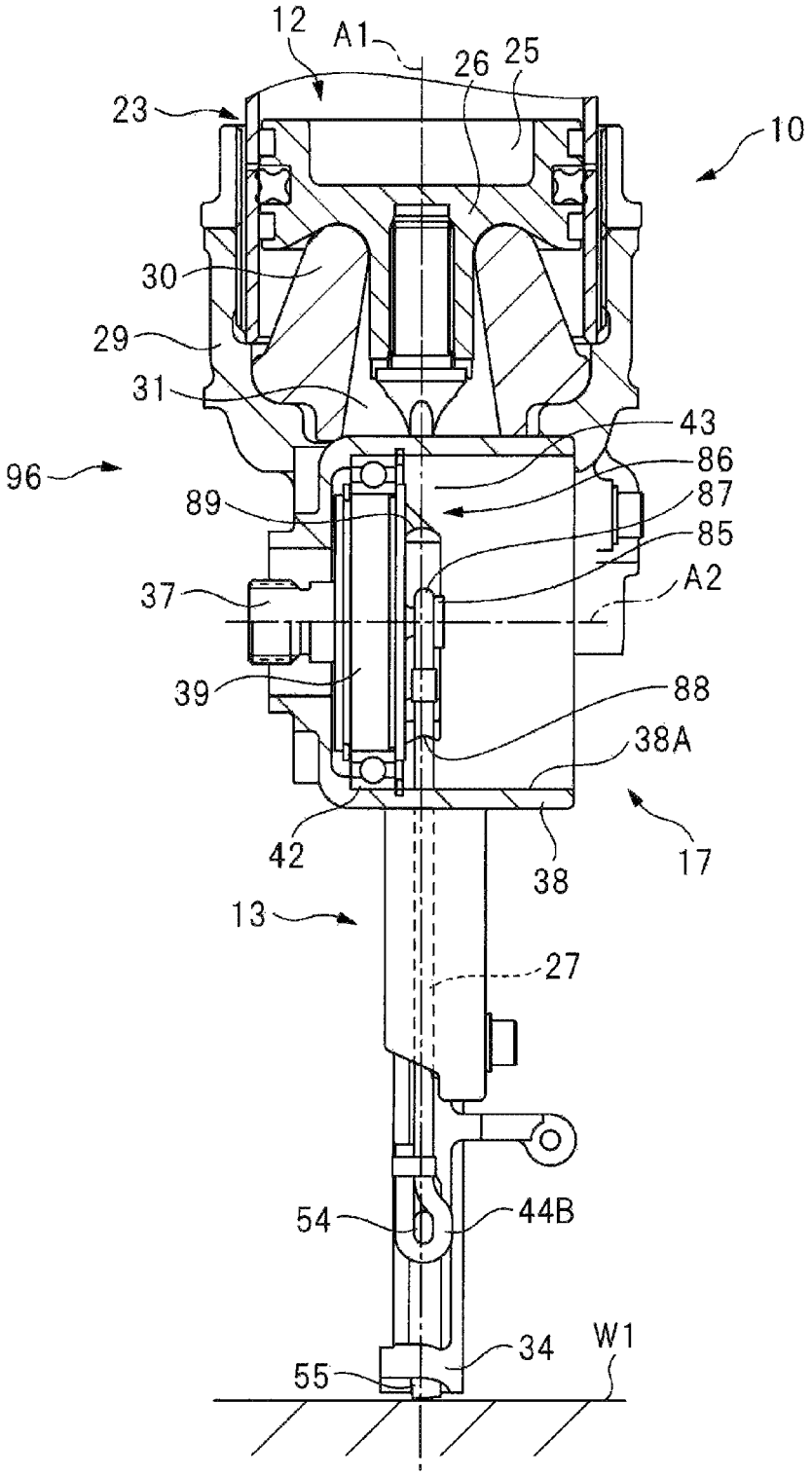
FIG. 13 is a front cross-sectional view of a state in which the striking part according to Embodiment 4 of the driving tool is disposed at the bottom dead center.

When the wheel 39 is rotated clockwise in FIG. 12, the engagement part 86 is engaged with the place 44A of the wire material 44, and the wheel 39 winds the wire material 44 in a state in which the wire material 44 is in contact with the support groove 88. The place 44A is an intermediate portion between the attachment part 85 and the attachment part 54 in the lengthwise direction of the wire material 44. As a result, the wheel 39 pulls the wire material 44. The wire material 44 and the engagement part 86 pass through the accommodating chamber 83. When the wheel 39 winds the wire material 44, the striking part 12 is raised from the bottom dead center toward the top dead center, and the pressure in the pressure accumulator 25 is increased.

Figure 14:
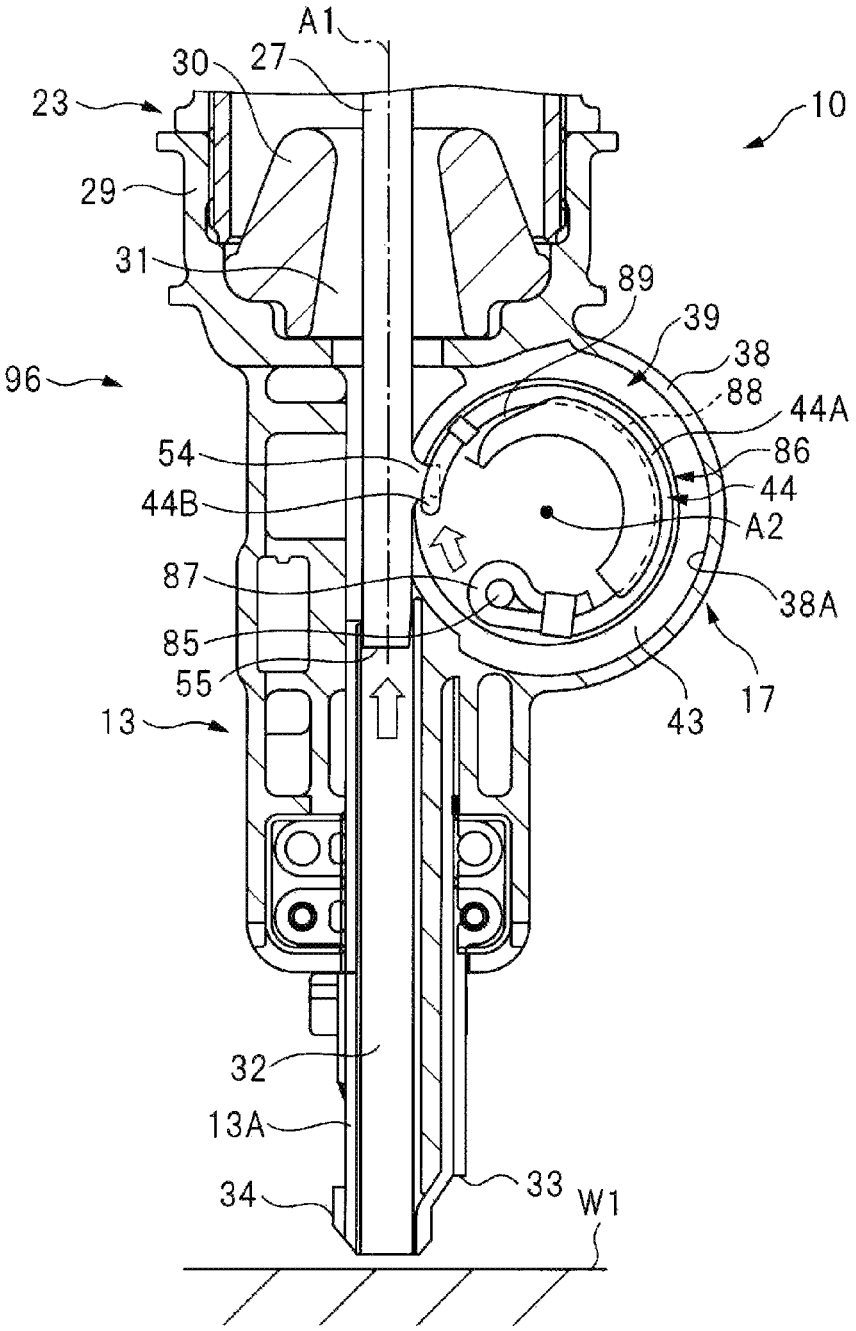
FIG. 14 is a left side cross-sectional view of a state in which the striking part according to Embodiment 4 of the driving tool is disposed at a top dead center.
Figure 15:
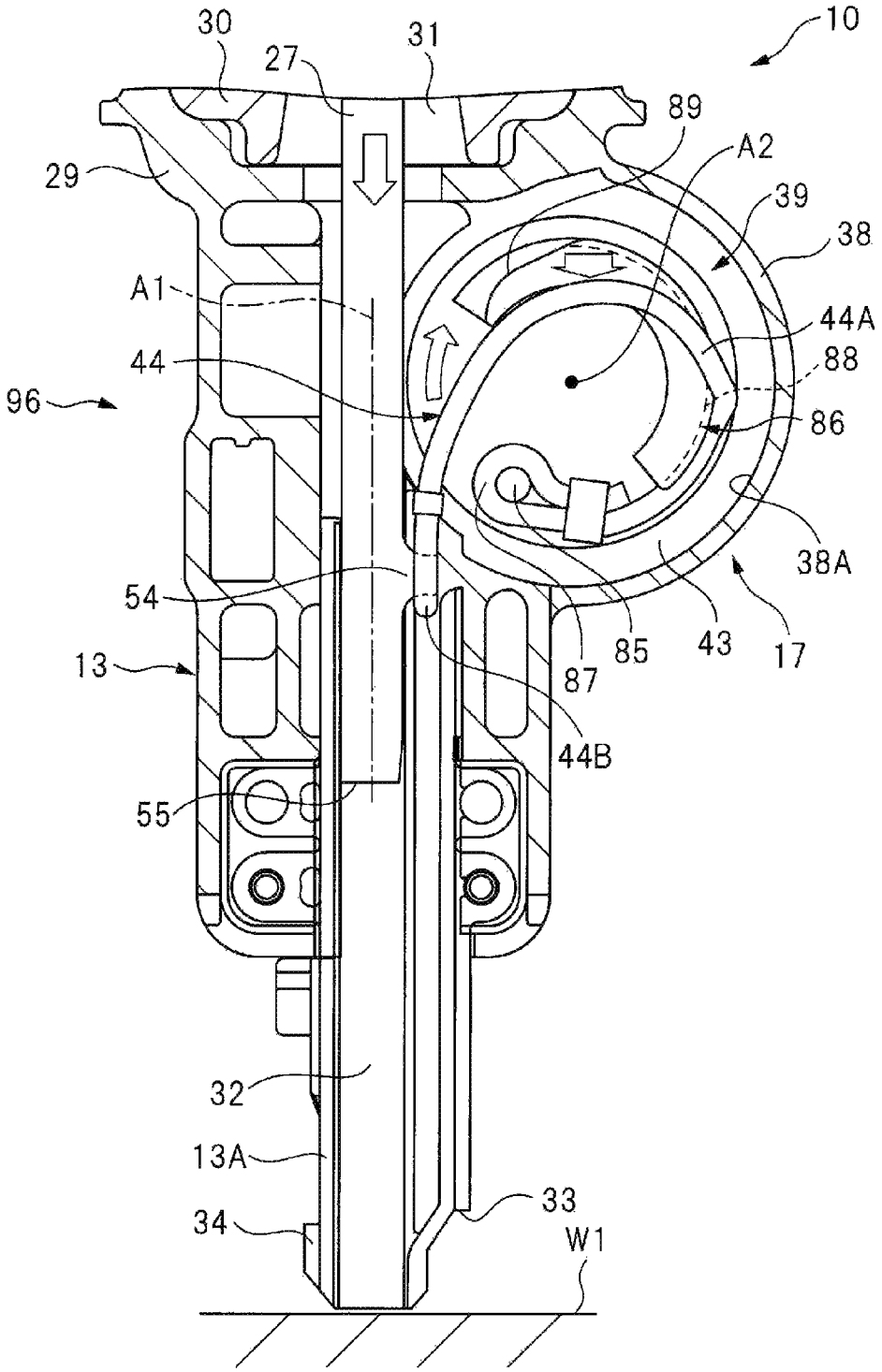
FIG. 15 is a left side cross-sectional view of a state in which the striking part according to Embodiment 4 of the driving tool is operated from the top dead center toward the bottom dead center.
Figure 17:
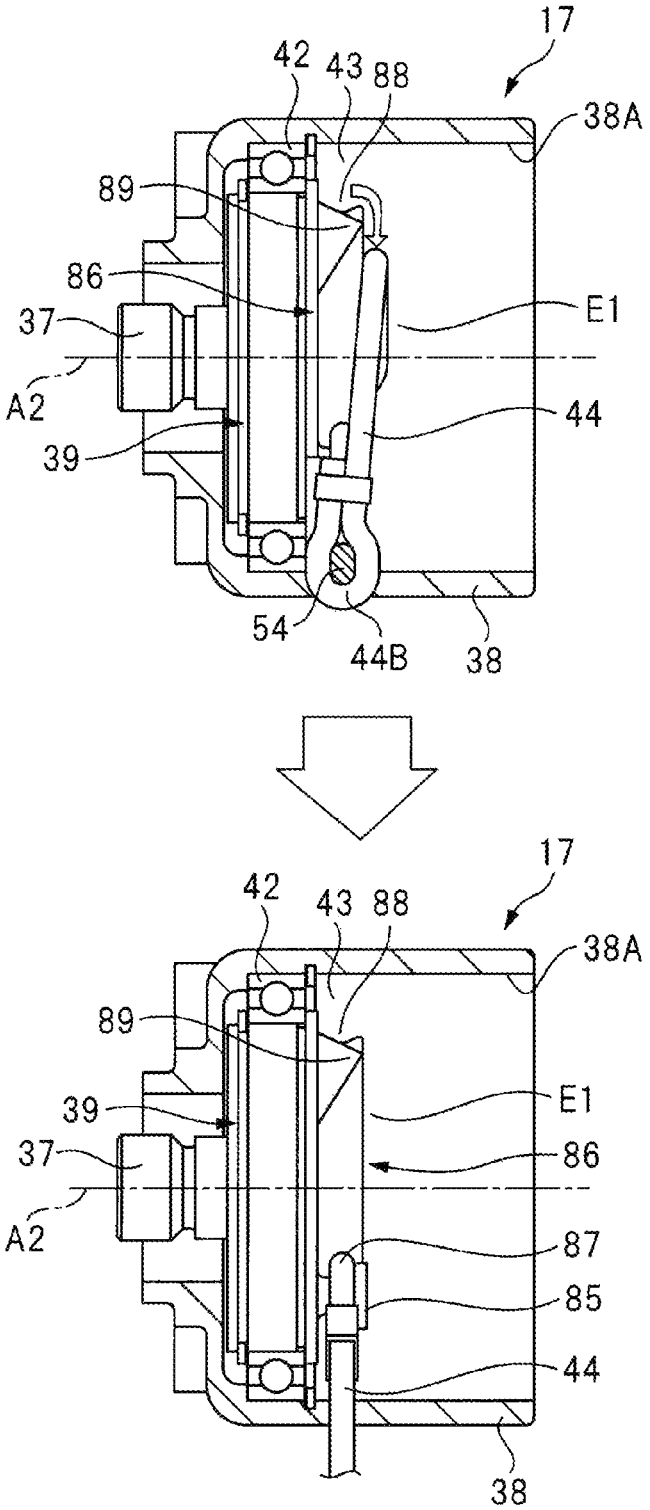
FIG. 17 is a front cross-sectional view showing a process of removing a wire material from a wheel according to Embodiment 4 of the driving tool.

As shown in FIG. 14, the notch 89 approaches the bumper 30 in the centerline A1 direction according to rotation of the wheel 39. When the wheel 39 is further rotated, the place of the wire material 44 that does not reach the notch 89 is not engaged with the engagement part 86. For this reason, as shown in FIG. 15 and an upper part of FIG. 17, a part of the wire material 44 moves to approach the attachment part 85 through a lateral space E1 of the wheel 39. The lateral space E1 is a side portion of the wheel 39 and the engagement part 86 in the centerline A2 direction. The lateral space E1 is connected to the passage 47. At least parts of the passage 47 and the lateral space E1 in the centerline A2 direction are disposed at different positions.

Figure 16:
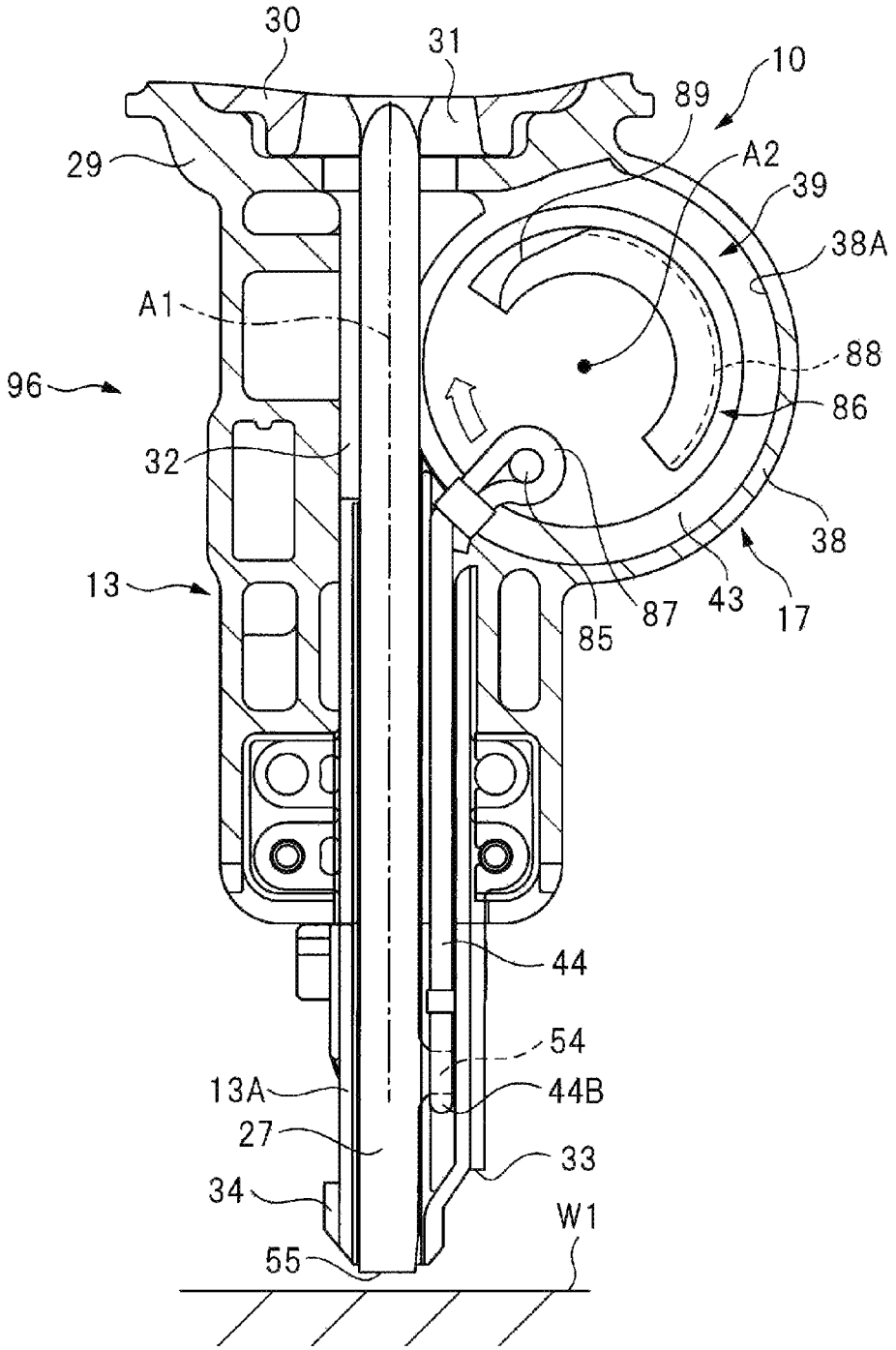
FIG. 16 is a front cross-sectional view of a state in which the striking part according to Embodiment 4 of the driving tool is lowered to reach the bottom dead center.

In addition, the place 44A of the wire material 44 engaged with the engagement part 86 is also removed from the engagement part 86. For this reason, the striking part 12 is operated from the top dead center toward the bottom dead center. Further, the striking part 12 reaches the bottom dead center as shown in FIG. 16. In addition, as shown in FIG. 16 and a lower part of FIG. 17, the entire wire material 44 is disengaged from the engagement part 86.

In Embodiment 4 of the driving tool 10, the same effects as in Embodiment 1 of the driving tool 10 can be obtained.

In addition, in Embodiment 4 of the driving tool 10, since both ends of the wire material 44 are fixed to the driver blade 27 and the wheel 39, respectively, the wire material 44 and the nose 96 does not have an engagement part, and thus, the structure is simplified. Accordingly, the product main body can be reduced in size and weight.

Further, in Embodiment 4 of the driving tool 10, since the wire material 44 passes through a side surface of the wheel 39 from the moment when the wire material 44 is disengaged from the engagement part 86. For this reason, when the striking part 12 is operated toward the bottom dead center, a frictional resistance between the wheel 39 and the wire material 44 is small. Accordingly, an influence on the operation of the striking part 12 can be minimized, and loss of kinetic energy when the striking part 12 is operated toward the bottom dead center can be reduced.

Embodiment 5

Next, another example of the converting part 17 provided in the driving tool 10 of FIG. 1 will be described with reference to FIGS. 18A and 18C. A wheel 100 is fixed to the rotating shaft 37. When the rotating shaft 37 is rotated, the wheel 100 is rotated about the centerline A2. The wheel 100 has a winding part 101 and a holding groove 102. The winding part 101 is an arc-shaped outer circumferential surface of the wheel 100. The holding groove 102 is provided in a range of the wheel 100 in the rotating direction except the winding part 101. The holding groove 102 forms a circular part in a flat surface perpendicular to the centerline A2.

A movable piece 103 is disposed in the holding groove 102. The movable piece 103 has a substantially columnar part that can be engaged with the holding groove 102, and is formed of a metal. The movable piece 103 is rotatable in the holding groove 102, i.e., autorotatable, in a flat surface perpendicular to the centerline A2. The movable piece 103 has a hook 104 and a guide part 105. The guide part 105 has an arc surface.

A hook guide 106 is provided in the accommodating chamber 43. The hook guide 106 is operable with respect to the casing 38, specifically, rotatable about the centerline A2. The hook guide 106 has a first regulating part 107 and a second regulating part 108. The first regulating part 107 is a part of the outer circumferential surface of the hook guide 106, and the first regulating part 107 is an arc surface about the centerline A2.

The second regulating part 108 is a groove formed in a part of the outer circumferential surface of the hook guide 106. The second regulating part 108 is provided in a range of the outer circumferential surface of the hook guide 106 except the first regulating part 107. The hook guide 106 has a guide part 109. The guide part 109 is a hole or a groove formed in the radial direction of the hook guide 106. A biasing member 116 shown in FIG. 18C is provided in the accommodating chamber 43, and the biasing member 116 biases the hook guide 106 clockwise. The biasing member 116 is a spring formed of a metal as an example.

A release lever 110 is provided on the ejection part 13. The release lever 110 is disposed between the driver blade 27 and the rotating shaft 37. The release lever 110 is supported by the ejection part 13 via a support shaft 111. The support shaft 111 is disposed at a side outward from the winding part 101 of the wheel 100 in the radial direction of the wheel 100. The release lever 110 is operable about the support shaft 111. A pin 112 is provided on the release lever 110, and the pin 112 is movable along the guide part 109.

The hook guide 106 is operable in a range of a predetermined angle about the centerline A2 in a state in which the pin 112 is engaged with the hook guide 106. A biasing force of the biasing member 116 is transmitted to the release lever 110 via the hook guide 106, and the release lever 110 is biased counterclockwise about the support shaft 111.

A stopper 128 is provided on the ejection part 13. The stopper 128 does not move with respect to the ejection part 13. In addition, the stopper 128 has an engagement part 113. The engagement part 113 is disposed in the ejecting path 32. As shown in FIG. 18D, two engagement parts 113 are disposed at an interval in a direction crossing the centerline A1.

A projection 115 is provided on the driver blade 27. The projection 115 is disposed between the piston 26 and the attachment part 54 in the operating direction of the driver blade 27. The projection 115 is disposed in the vicinity of the attachment part 54 in the operating direction of the driver blade 27. An annular wire material 114 is disposed in the ejecting path 32. An example of a material of the wire material 114 is the same as that of the material of the wire material 44. The blade guide 13A restricts the place of the wire material 114 that is not engaged with the hook 104 and not wound on the wheel 100 from moving in the direction crossing the centerline A1 in the ejecting path 32, specifically, moving in the direction away from the driver blade 27.

Next, an operation of the driving tool 10 of Embodiment 5 will be described. When the striking part 12 is stopped at the bottom dead center shown in FIG. 18A, the engagement part 113 is engaged with the wire material 114, and the attachment part 54 does not come into contact with the wire material 114. For this reason, no tension is added to the wire material 114 from the driver blade 27.

In addition, a force of the biasing member 116 is transmitted to the release lever 110 via the hook guide 106, and the release lever 110 is pressed against the stopper 128. For this reason, the release lever 110 is stopped and the hook guide 106 is stopped. A virtual line B1 disposed in the second regulating part 108 is a position parallel to the centerline A1. The virtual line B1 crosses the centerline A2. Further, the projection 115 is separated from the release lever 110.

In addition, the movable piece 103 is stopped at a position closest to the driver blade 27 in the rotating direction of the wheel 100. The guide part 105 comes into contact with the first regulating part 107 of the hook guide 106 and stops, and the hook 104 is disposed in the ejecting path 32. The hook 104 is disposed inside the annular wire material 114.

Figure 18A:
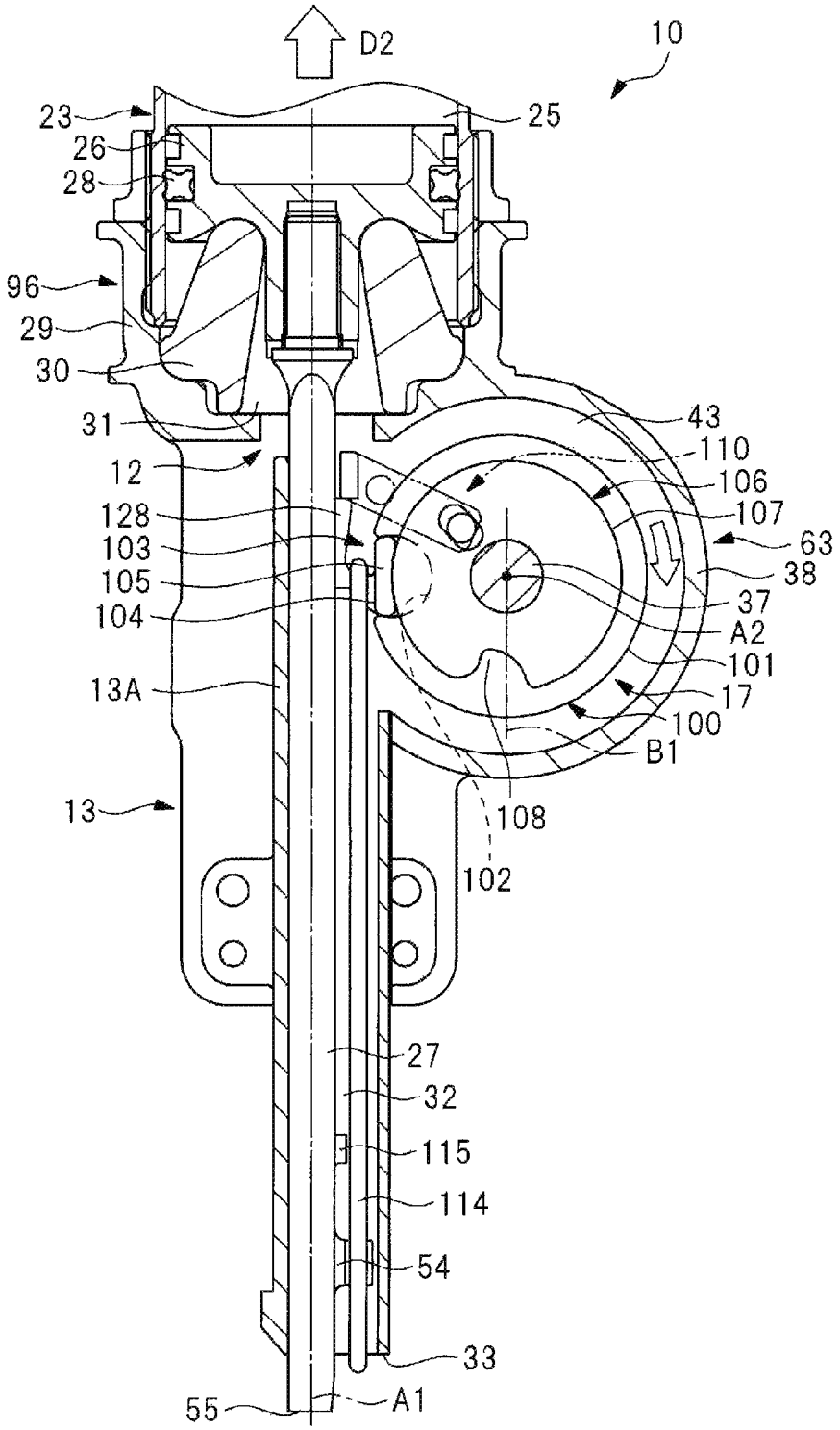
FIG. 18A is a left side cross-sectional view of the case in which a circumferential length of a wire material according to Embodiment 5 of the driving tool is increased and a striking part is disposed at a bottom dead center.

When the wheel 100 is rotated clockwise in FIG. 18A and the hook 104 is engaged with the wire material 114, the wire material 114 moves through the ejecting path 32 in the centerline A1 direction. When the wheel 100 is rotated clockwise in a state in which the hook 104 is engaged with the wire material 114, the wire material 114 is separated from the engagement part 113. The striking part 12 is stopped at the bottom dead center at the moment before the attachment part 54 is engaged with the wire material 114. When the attachment part 54 is engaged with the wire material 114, the striking part 12 is raised from the bottom dead center toward the top dead center by a pulling force from the wire material 114.

Since the wire material 114 pulls the striking part 12 against a force applied from the pressure accumulator 25 to the striking part 12, the wire material 114 receives a load. The load applied to the wire material 114 is transmitted to the movable piece 103, and the movable piece 103 receives a counterclockwise autorotating force as shown in FIG. 18A. However, when the guide part 105 is pressed against the first regulating part 107, the movable piece 103 does not autorotate.

When the wheel 100 is continuously rotated clockwise as shown in FIG. 18A, a state in which the guide part 105 is in contact with the first regulating part 107 is maintained, and the movable piece 103 revolves around the centerline A2. The wire material 114 is moved from the ejecting path 32 to the accommodating chamber 43 and wound on the winding part 101 of the wheel 100. In addition, when the striking part 12 is further raised and the projection 115 is separated from the release lever 110, the release lever 110 is stopped and the hook guide 106 is stopped.

Figure 18B:
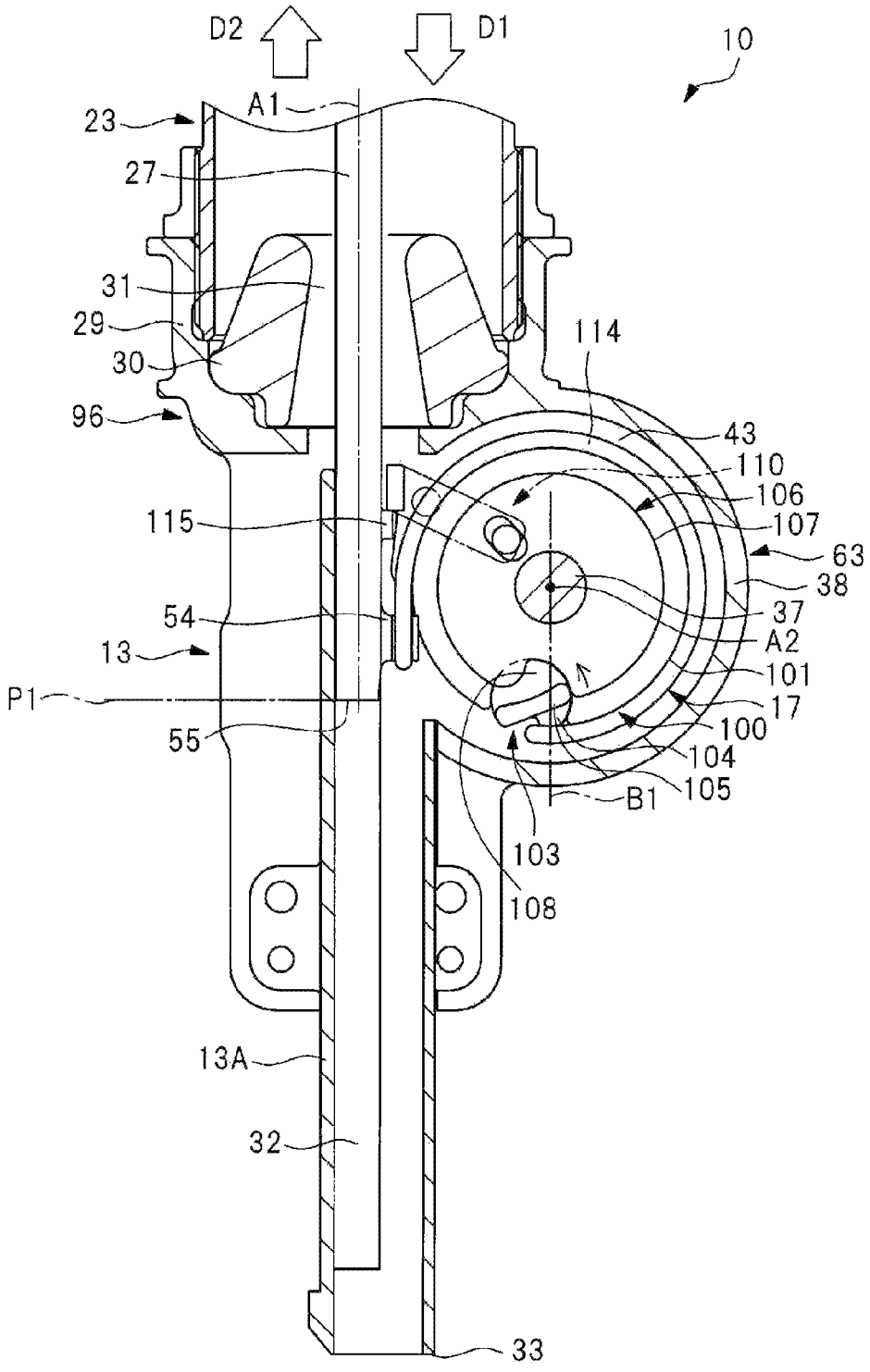
FIG. 18B is a left side cross-sectional view of the case in which the circumferential length of the wire material according to Embodiment 5 of the driving tool is increased and the striking part is disposed at a top dead center.
Figure 18C:
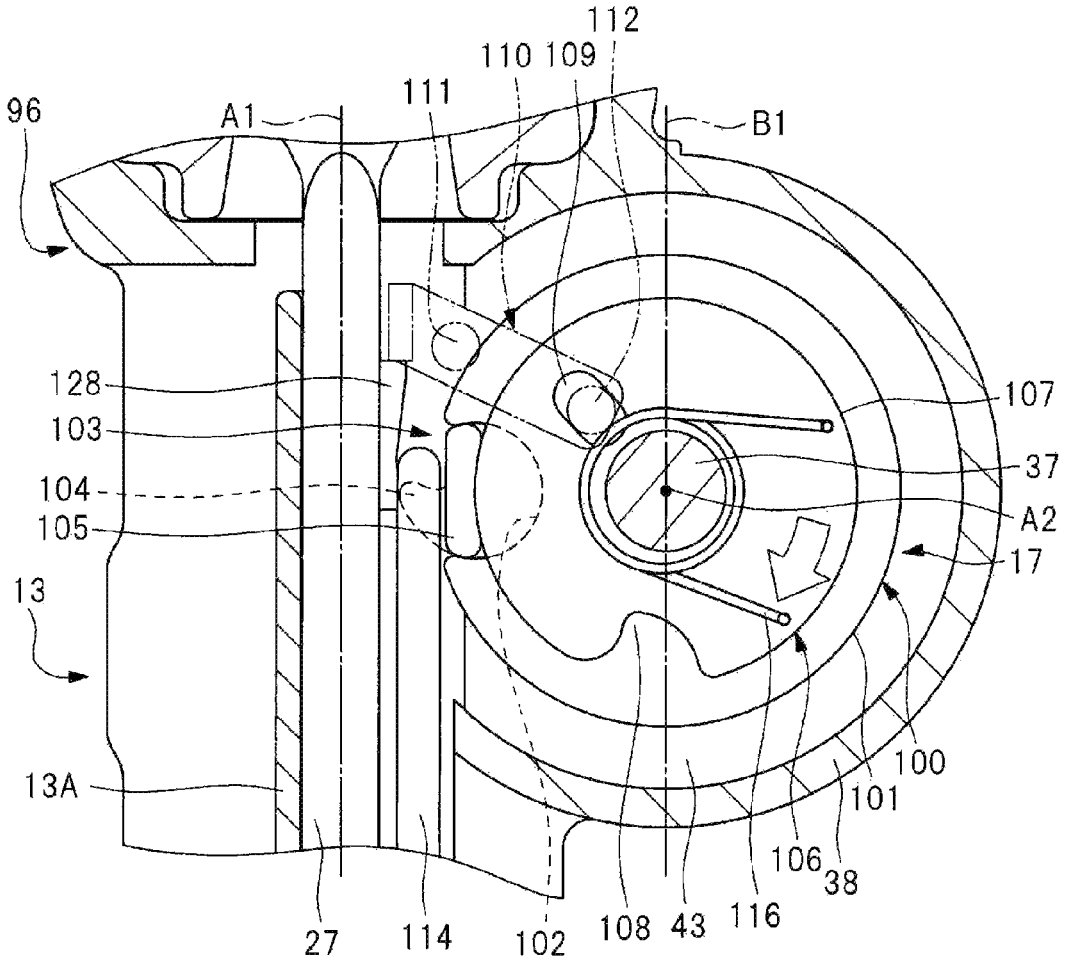
FIG. 18C is a left side cross-sectional view showing a major part according to Embodiment 5 of the driving tool.
Figure 18D:
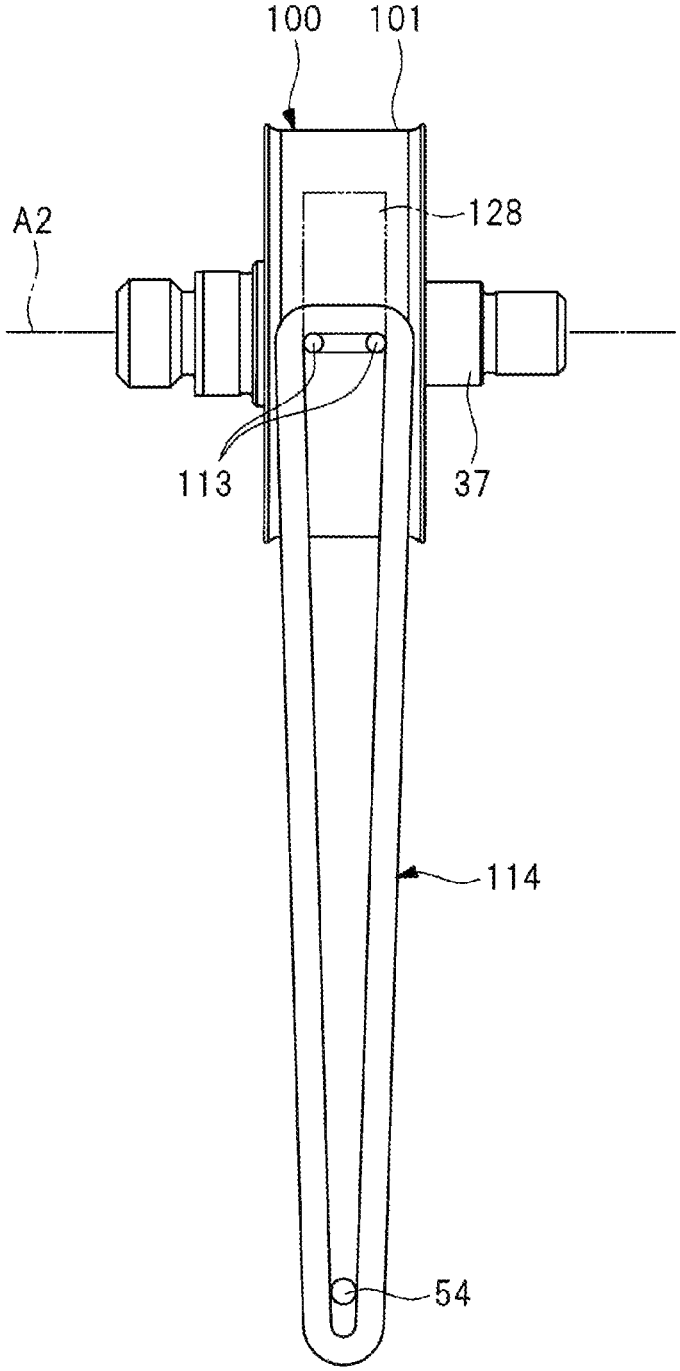
FIG. 18D is a view showing the entire shape of the wire material according to Embodiment 5 of the driving tool.

Then, in a state in which the projection 115 is separated from the release lever 110, when the movable piece 103 reaches a disposition position of the second regulating part 108 in the rotating direction of the wheel 100, the guide part 105 enters the second regulating part 108. Then, the movable piece 103 autorotates counterclockwise as shown in FIG. 18B, the hook 104 releases the wire material 114. The striking part 12 is disposed at the top dead center immediately before the hook 104 releases the wire material 114. The tip 55 of the driver blade 27 corresponding to the top dead center of the striking part 12 is a position P1 in the centerline A1 direction. Then, the striking part 12 is lowered from the top dead center by the pressure in the pressure accumulator 25, and the driver blade 27 strikes the nail 59.

In addition, since the attachment part 54 is engaged with the wire material 114, at the same time when the driver blade 27 is lowered, the wire material 114 is moved and pulled out from the accommodating chamber 43 to the ejecting path 32. Since the wheel 100 is rotated clockwise even when the driver blade 27 is being lowered and the guide part 105 is pressed against the hook guide 106, the movable piece 103 autorotates clockwise as shown in FIG. 18B. For this reason, the guide part 105 is being pressed against the first regulating part 107.

Then, when the wheel 100 is stopped, as shown in FIG. 18A, the movable piece 103 is stopped at a position closest to the driver blade 27 in the rotating direction of the wheel 100.

Next, an operation of the driving tool 10 in the case in which a circumferential length of the wire material 114 is smaller than a circumferential length of the wire material 114 shown in FIG. 18A will be described with reference to FIG. 19A. When the striking part 12 is stopped at the bottom dead center shown in FIG. 19A, the engagement part 113 is in contact with the wire material 114 and the attachment part 54 is in contact with the wire material 114. A position of another element and a positional relation of elements are the same as in FIG. 18A.

Figure 19A:
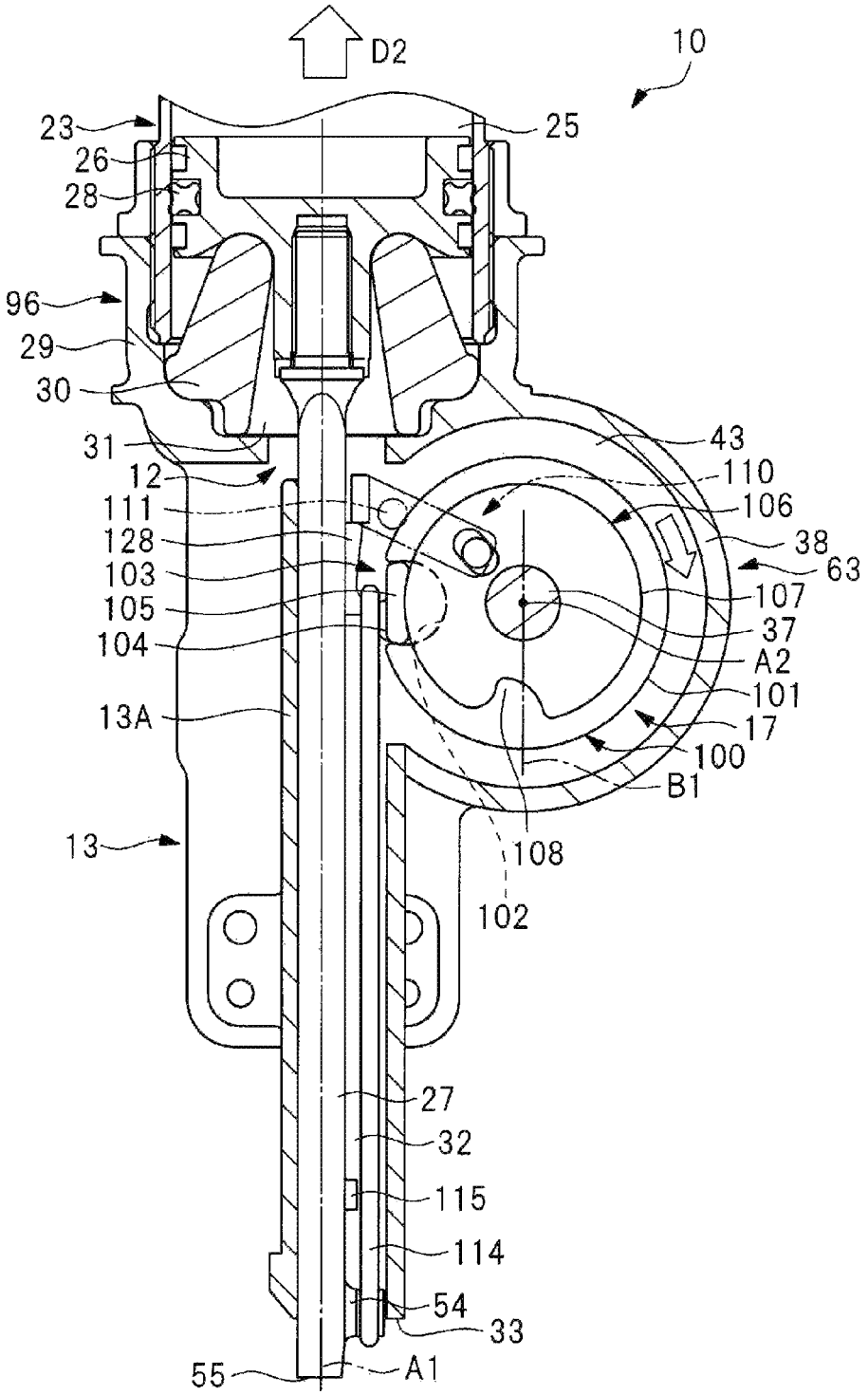
FIG. 19A is a left side cross-sectional view of the case in which the circumferential length of the wire material according to Embodiment 5 of the driving tool is decreased and the striking part is disposed at the bottom dead center.
Figure 19B:
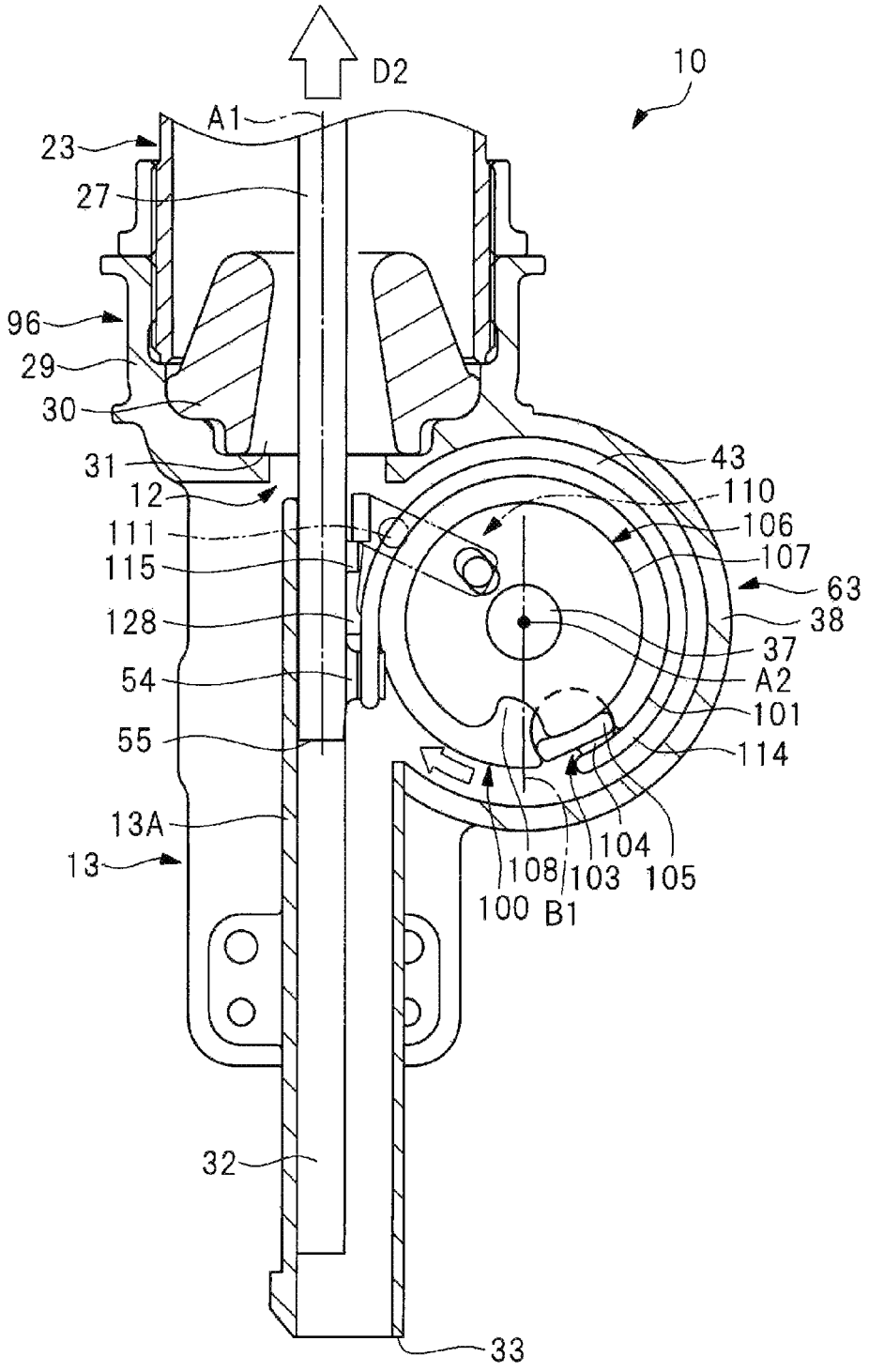
FIG. 19B is a left side cross-sectional view of the case in which the circumferential length of the wire material according to Embodiment 5 of the driving tool is decreased and the striking part is raised from the bottom dead center.

A pulling force from the wire material 114 is transmitted to the striking part 12 at the moment when the wheel 100 starts to rotate clockwise in FIG. 19A, and the striking part 12 is raised from the bottom dead center. The wire material 114 is driven to the accommodating chamber 43 and wound on the winding part 101 according to rotation of the wheel 100. Then, as shown in FIG. 19B, the projection 115 comes into contact with the release lever 110 before the movable piece 103 reaches the disposition position of the second regulating part 108 in the rotating direction of the wheel 100. This is because the circumferential length of the wire material 114 shown in FIG. 19A is smaller than the circumferential length of the wire material 114 shown in FIG. 18A.

Then, an operating force of the driver blade 27 is transmitted to the release lever 110, and the release lever 110 is operated clockwise about the support shaft 111 as shown in FIG. 19B. For this reason, the release lever 110 is separated from the stopper 128, and the release lever 110 is stopped at the position shown in FIG. 19C. In addition, the hook guide 106 is operated counterclockwise as shown in FIG. 19B, and stopped at the position shown in FIG. 19C. When the hook guide 106 is operated counterclockwise, the position of the second regulating part 108 in the rotating direction of the wheel 100 is changed. As a result, a virtual line B2 passing through the second regulating part 108 and the centerline A2 is stopped at a position displaced with respect to the virtual line B1 by an angle θ2. The angle θ2 is an angle on the side of an acute angle formed between the virtual line B1 and the virtual line B2.

Figure 19C:
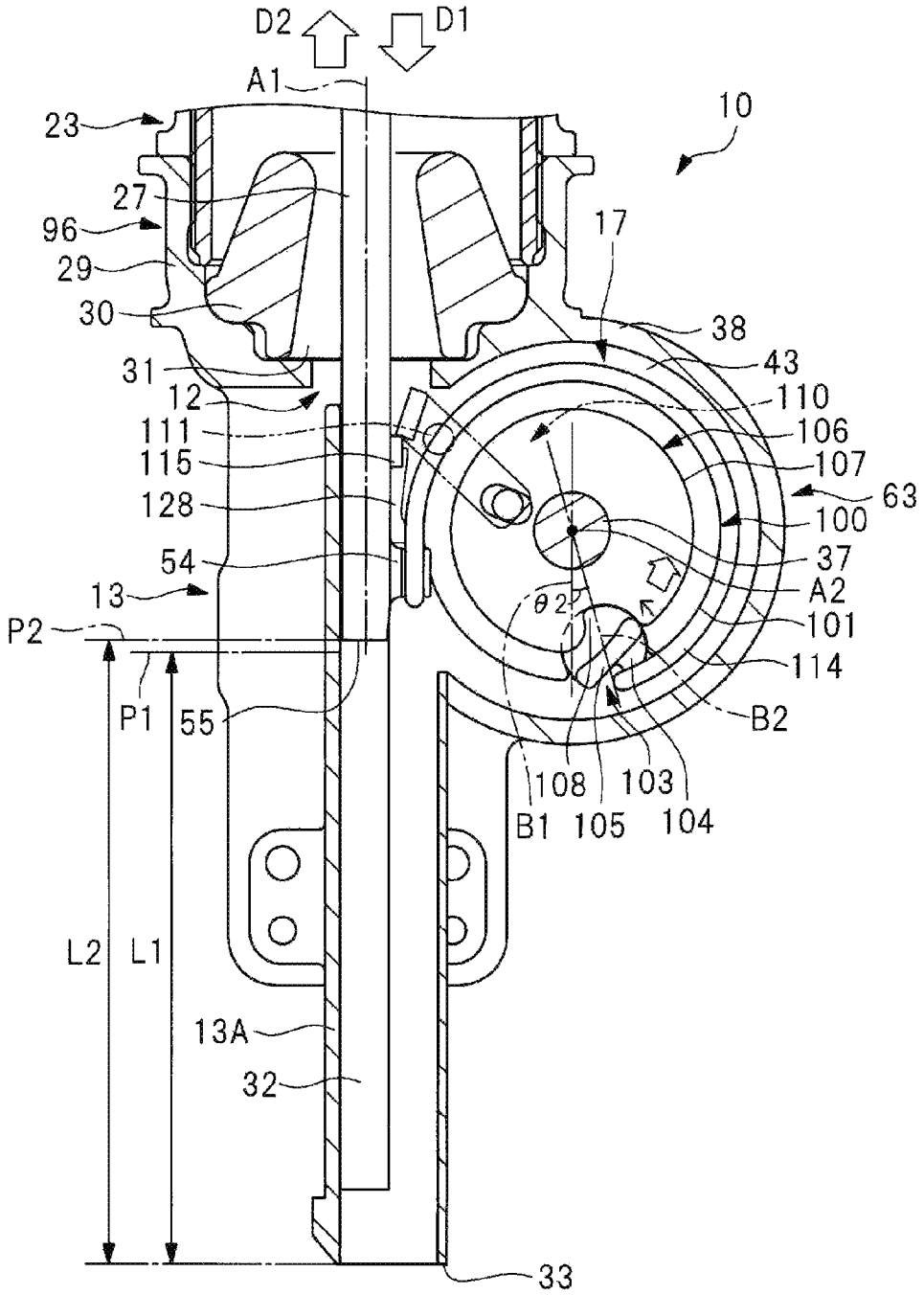
FIG. 19C is a left side cross-sectional view of the case in which the circumferential length of the wire material according to Embodiment 5 of the driving tool is decreased and the striking part is disposed at the top dead center.

Further, when the guide part 105 enters the second regulating part 108 with the tension of the wire material 114, the movable piece 103 autorotates counterclockwise as shown in FIG. 19C, and the hook 104 releases the wire material 114. The position of the striking part 12 immediately before the hook 104 releases the wire material 114 is the top dead center. The position of the tip 55 of the driver blade 27 corresponding to the top dead center of the striking part 12 is, for example, a position P2 in the centerline A1 direction. Then, the striking part 12 is lowered from the top dead center by the pressure in the pressure accumulator 25, and the driver blade 27 strikes the nail 59.

In addition, since the attachment part 54 is engaged with the wire material 114, at the same time the driver blade 27 is lowered, the wire material 114 is pulled out from the accommodating chamber 43 to the ejecting path 32. Since the wheel 100 is rotated clockwise even when the driver blade 27 is being lowered and the guide part 105 is pressed against the hook guide 106, the movable piece 103 autorotates clockwise in FIG. 19C. For this reason, the guide part 105 is being pressed against the first regulating part 107.

When the striking part 12 is lowered, the projection 115 is separated from the release lever 110, the hook guide 106 is operated clockwise by a force of the biasing member 116, the release lever 110 is pressed against the stopper 128 as shown in FIG. 19A, and the release lever 110 and the hook guide 106 are stopped. Then, when the electric motor 15 is stopped and the wheel 100 is stopped, the movable piece 103 is stopped at the position closest to the driver blade 27 in the rotating direction of the wheel 100 as shown in FIG. 19A.

An angle by which the wheel 100 is rotated from the position where the wheel 100 starts to rotate as shown in FIG. 18A to the position where the hook 104 releases the wire material 114 as shown in FIG. 18B is a first angle. In addition, an angle by which the wheel 100 is rotated from the position where the wheel 100 starts to rotate as shown in FIG. 19A to the position where the hook 104 releases the wire material 114 as shown in FIG. 19C is a second angle. Then, the first angle is larger than that second angle. The first angle is, for example, 280 degrees, and the second angle is, for example, 265 degrees.

For this reason, even when the circumferential lengths of the wire material 114 are different, a distance between the position P1 and the position P2 in the centerline A1 direction can be made as small as possible. In other words, a difference between a distance L1 from the tip 33 to the position P1 and a distance L2 from the tip 33 to the position P2 can be made as small as possible. Accordingly, when the circumferential lengths of the wire material 114 are different, a variation in response time from the moment that an operator applies an operating force to the trigger 62 to the moment that the striking part 12 reaches the top dead center can be minimized. In addition, when the circumferential lengths of the wire material 114 are different, a variation in power operated in the direction in which the striking part 12 strikes the nail 59 can be minimized.

Further, the position P1 and the position P2 shown in FIG. 19C are examples of positions of the tip 55 of the driver blade 27 in the centerline A1 direction. The position of the tip 55 of the driver blade 27 in the centerline A1 direction is determined according to the circumferential length of the wire material 114 and the angle θ2 shown in FIG. 19C.

Further, when a disposition position of the support shaft 111 is changed between the guide part 109 and the place with which the stopper 128 is in contact in the release lever 110, a moving amount of the guide part 109 with respect to an operating angle of the release lever 110 can be changed.

Further, another example of the converting part 17 that can be used in the driving tool 10 of FIG. 1 will be described with reference to FIG. 20A. In a configuration shown in FIG. 20A, the same components as those in FIG. 18A are designated by the same reference signs as those in FIG. 18A. A solenoid actuator 117 is provided in the housing 11 shown in FIG. 1. The solenoid actuator 117 has a cylinder 118, a plunger 119 and a coil 120.

The cylinder 118 is fixed in the housing 11. The plunger 119 is disposed throughout the inside and the outside of the cylinder 118. The plunger 119 is operable. The plunger 119 is formed of a magnetic material, for example, iron. The coil 120 is provided in the cylinder 118. The coil 120 is obtained by winding a conductive wire. A switch 125 is provided in the housing 11. The coil 120 is electrically connected to the switch 125.

A release lever 121 is disposed throughout the inside and the outside of the casing 38. The release lever 121 is connected to the plunger 119. The casing 38 has a hole 129, and the release lever 121 is movable in the hole 129. A pin 124 is provided at a place of the release lever 121 disposed in the casing 38, and the pin 124 is movable along the guide part 109.

A spring 122 is provided outside the cylinder 118, and the spring 122 biases the release lever 121 and the plunger 119. The cylinder 118 has a stopper 123, and the plunger 119 biased by the spring 122 comes in contact with the stopper 123 and stops.

A permanent magnet 126 is attached to the driver blade 27, and a magnetic sensor 127 is provided on the ejection part 13. The magnetic sensor 127 detects intensity of the magnetic force of the permanent magnet 126, and outputs a signal according to the detection result. The control part 60 processes the signal of the magnetic sensor 127 and controls ON and OFF of the switch 125. Further, the converting part 17 in FIG. 20A does not include the release lever 110 and the support shaft 111 shown in FIG. 18A. In addition, the driver blade 27 does not include the projection 115.

Next, an operation of the converting part 17 shown in FIG. 20A will be described. When the striking part 12 is stopped at the bottom dead center shown in FIG. 20A, the control part 60 turns off the switch 125. For this reason, current of the power supply unit 14 is not supplied to the solenoid actuator 117, and the plunger 119 is stopped at an initial position by the stopper 123. When the plunger 119 is stopped at the initial position, the virtual line B1 is disposed a position parallel to the centerline A1.

Figure 20A:
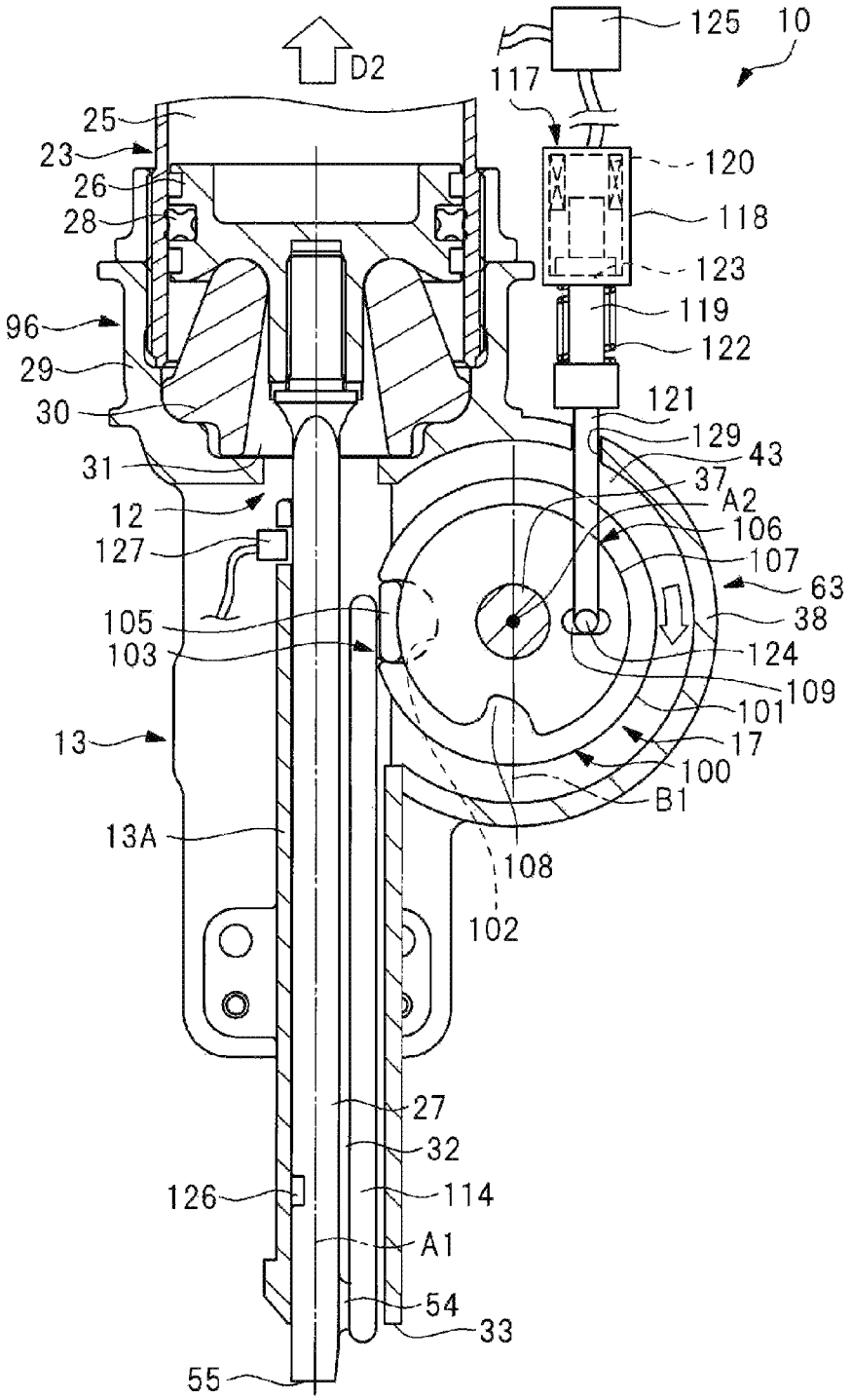
FIG. 20A is a left side cross-sectional view of the case in which a striking part according to another example of Embodiment 5 of the driving tool is disposed at a bottom dead center.

When the electric motor 15 is rotated and the wheel 100 is rotated clockwise as shown in FIG. 20A, the striking part 12 rises on the same principle as the striking part 12 shown in FIG. 18A while the hook 104 is engaged with the wire material 114.

The control part 60 controls ON and OFF of the switch 125 according to the signal of the magnetic sensor 127. When the control part 60 turns on the switch 125, the current is supplied from the power supply unit 14 to the solenoid actuator 117. When the control part 60 turns off the switch 125, no current is supplied to the solenoid actuator 117. Since the control part 60 controls the solenoid actuator 117, the striking part 12 can change the top dead center. Specifically, the top dead center of the striking part 12 is changed according to the circumferential length of the wire material 114. Here, an example in which the circumferential lengths of the wire material 114 are two of a long one and a short one will be described.

When the circumferential length of the wire material 114 is long, before the magnetic sensor 127 detects the permanent magnet 126, the movable piece 103 reaches the disposition position of the second regulating part 108 in the rotating direction of the wheel 100. Then, the guide part 105 enters the second regulating part 108, the movable piece 103 autorotates counterclockwise, and the hook 104 releases the wire material 114. Accordingly, the striking part 12 lowers the pressure of the pressure accumulator 25. The control part 60 normally turns off the switch 125 when the circumferential length of the wire material 114 is long. For this reason, the virtual line B1 is normally disposed at the position parallel to the centerline A1. Further, another operation of the converting part 17 when the circumferential length of the wire material 114 is long is the same as the operation of the converting part 17 shown in FIGS. 18A and 18B.

Figure 20B:
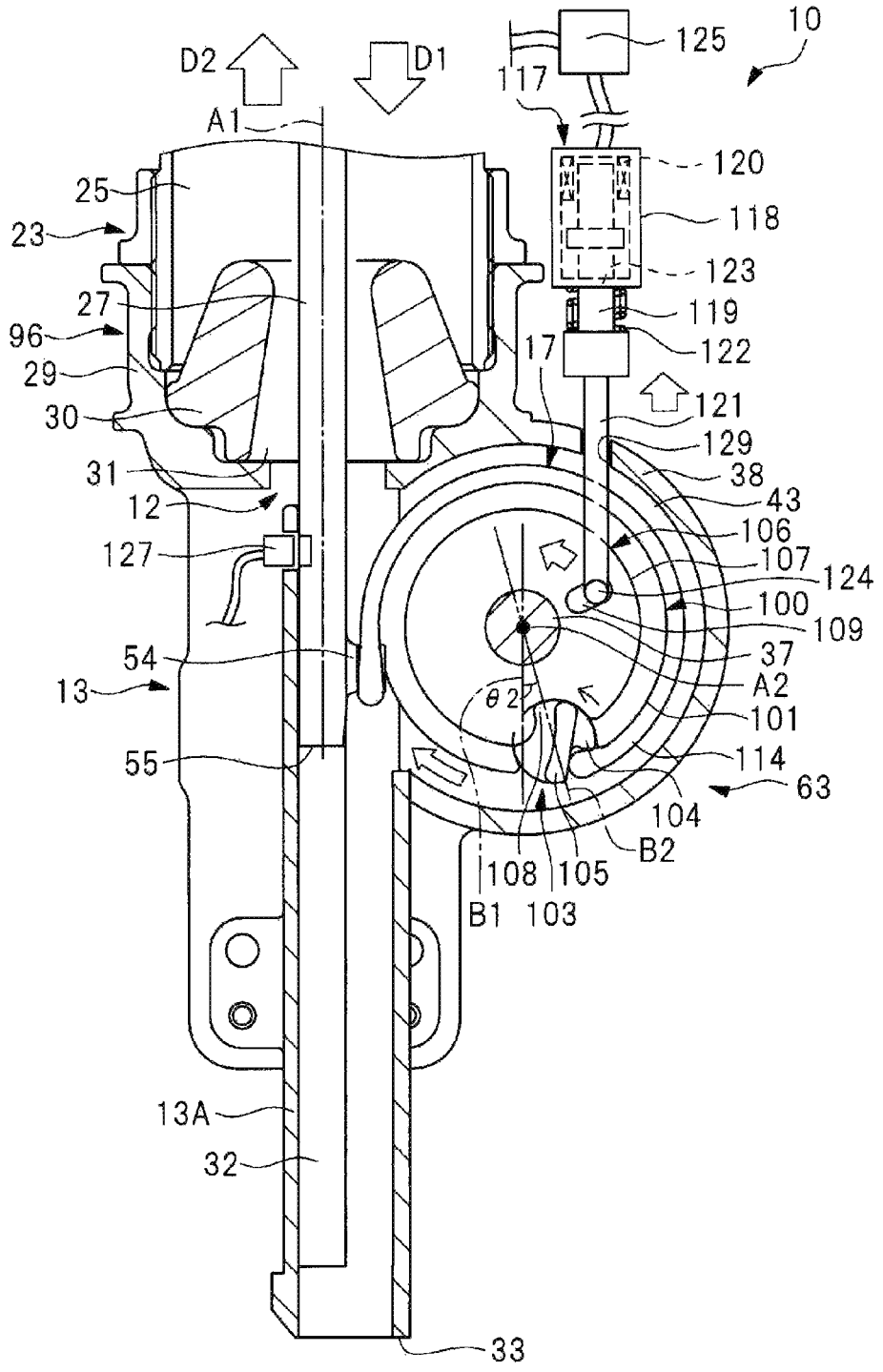
FIG. 20B is a left side cross-sectional view of the case in which the striking part according to the other example of Embodiment 5 of the driving tool is disposed at a top dead center.

When the circumferential length of the wire material 114 is short, before the movable piece 103 reaches the disposition position of the second regulating part 108 in the rotating direction of the wheel 100, the magnetic sensor 127 detects the permanent magnet 126 and outputs the detected signal. Then, when the control part 60 turns on the switch 125, the current of the power supply unit 14 is supplied to the solenoid actuator 117. Then, the coil 120 generates a magnetic attraction force, and the plunger 119 is operated against the force of the spring 122 and separated from the stopper 123 and stops as shown in FIG. 20B.

An operating force of the plunger 119 is transmitted to the pin 124 via the release lever 121, and the hook guide 106 is operated counterclockwise and stops. For this reason, the disposition position of the second regulating part 108 in the rotating direction of the wheel 100 is changed. As a result, the virtual line B2 disposed in the second regulating part 108 is displaced with respect to the virtual line B1 by the angle θ2. Further, the guide part 105 enters the second regulating part 108, the movable piece 103 autorotates counterclockwise as shown in FIG. 20B, and the hook 104 releases the wire material 114. The position of the striking part 12 immediately before the hook 104 releases the wire material 114 is the top dead center. Then, the striking part 12 is lowered from the top dead center by the pressure in the pressure accumulator 25.

When the striking part 12 is lowered and the signal of the magnetic sensor 127 is changed, the control part 60 turns off the switch 125. For this reason, the current from the power supply unit 14 to the solenoid actuator 117 is blocked, the plunger 119 is pressed against the stopper 123 by the force of the spring 122, and the plunger 119 is stopped at the initial position. The operating force of the plunger 119 is transmitted to the pin 124 via the release lever 121. Then, the hook guide 106 is operated clockwise as shown in FIG. 20B, and stops at the position shown in FIG. 20A. The driving tool 10 having the converting part 17 shown in FIG. 20A can obtain the same effects as that of the driving tool 10 having the converting part 17 shown in FIG. 18A.

Further, another example of the converting part 17 that can be used in the driving tool 10 of FIG. 1 will be described with reference to FIG. 21A. The hook guide 106 does not rotate with respect to the casing 38. The converting part 17 shown in FIG. 21A does not include the guide part 109, the release lever 110, the support shaft 111 and the pin 112, which are shown in FIG. 18A. In addition, the driver blade 27 does not include the projection 115.

Figure 21A:
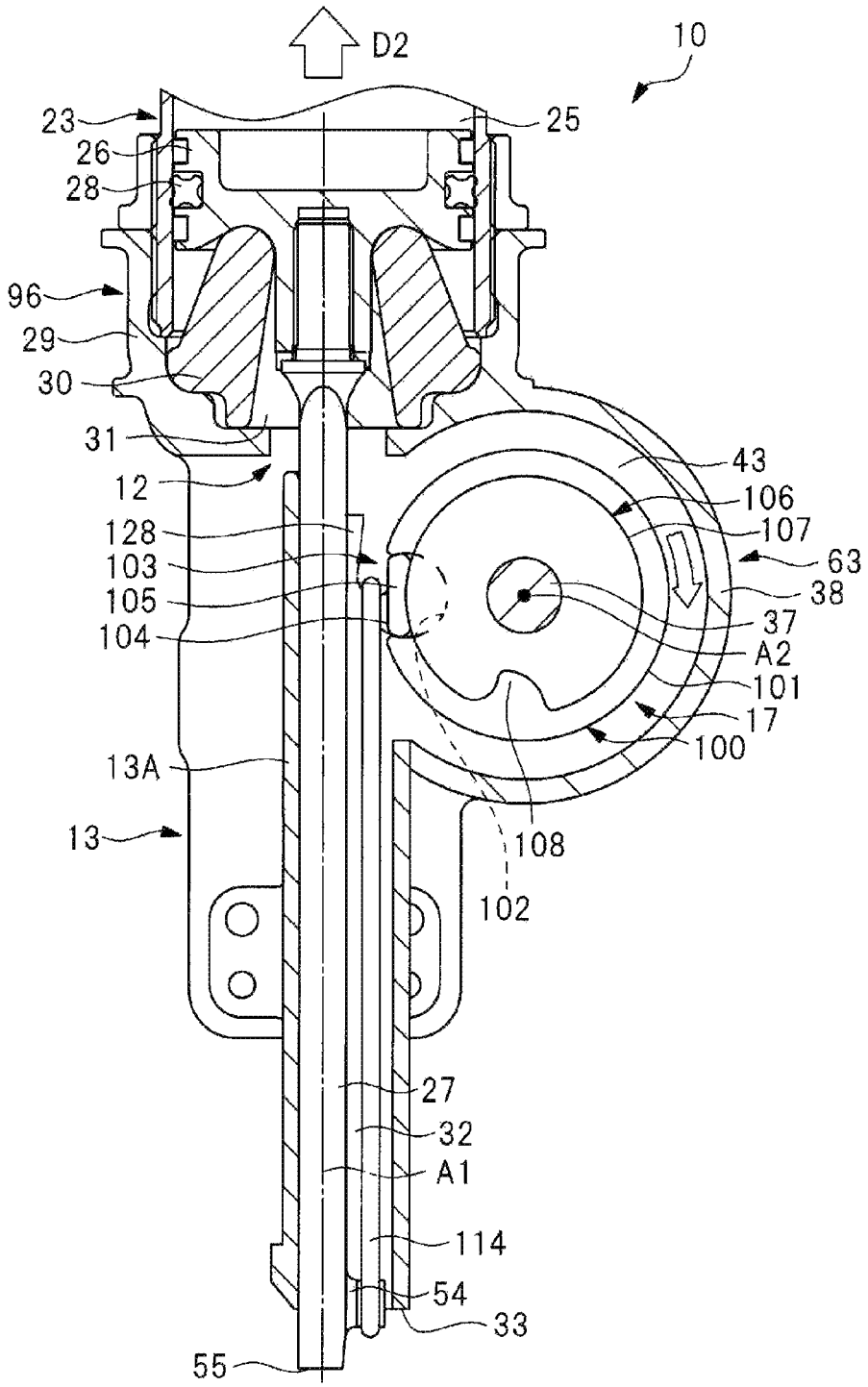
FIG. 21A is a left side cross-sectional view of the case in which a striking part according to a still another example of Embodiment 5 of the driving tool is disposed at a bottom dead center.
Figure 21B:
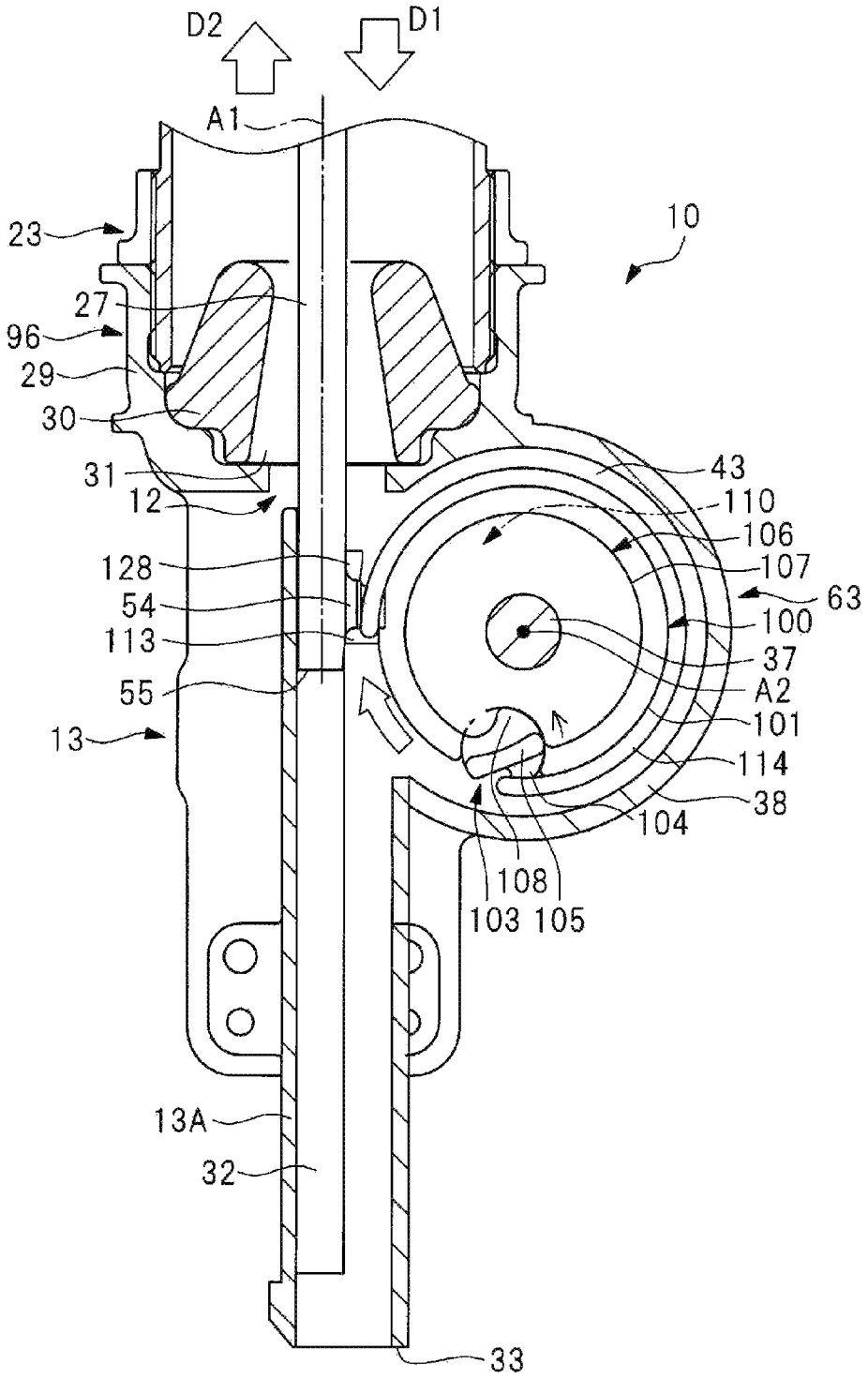
FIG. 21B is a left side cross-sectional view of the case in which the striking part according to the still other example of Embodiment 5 of the driving tool is disposed at a top dead center.

As shown in FIG. 21A, when the wheel 100 is rotated clockwise in a state in which the striking part 12 is disposed at the bottom dead center, the striking part 12 rises on the same principle as the striking part 12 shown in FIG. 18A. Further, when the movable piece 103 reaches the disposition position of the second regulating part 108 in the rotating direction of the wheel 100, the guide part 105 enters the second regulating part 108 with tension of the wire material 114. Then, the movable piece 103 autorotates counterclockwise as shown in FIG. 21B, the hook 104 releases the wire material 114. For this reason, the striking part 12 is operated from the top dead center toward the bottom dead center.

In the driving tool 10 of Embodiment 5, the entire wire material 114 and the driving part 63 are provided between the bumper 30 and the tip 33 of the blade guide 13A in the operating direction of the striking part 12. That is, the disposition region of the ejection part 13 and the disposition region of the entire wire material 114 and the driving part 63 at least partially overlap each other in the centerline A1 direction. Accordingly, an increase in size of the driving tool 10 in the centerline A1 direction can be minimized.

Further, in the driving tool 10 of Embodiment 5, maintenance of the parts is performed by exchange of the wire material 114. That is, the maintenance is performed without exchanging the entire striking part 12 including the driver blade 27 or the wheel 100. Accordingly, a maintenance property is improved. Further, since the wire material 114 is disposed outside the element that forms the pressure accumulator 25, sealability of the pressure accumulator 25 can be improved.

In Embodiments 1, 2, 3, 4 and 5 of the driving tool 10, a standby position of the striking part 12 may be in a state in which the piston 26 is disposed between the top dead center and the bottom dead center or a state in which the piston 26 is disposed at the top dead center, in addition to the state in which the piston 26 is disposed at the bottom dead center.

An example of relations between matters described in some embodiments and matters disclosed in claims 1 to 10 is as follows. The driving tool 10 is an example of a driving tool. The nail 59 is an example of a fastener. The ejection part 13 is an example of an ejection part. The pressure accumulator 25 is an example of a pressure accumulator. The striking part 12 is an example of a striking part. The wire material 44 is an example of a wire material. The driving part 63 is an example of a driving part. The housing 11 is an example of a housing. The tank 24 is an example of a casing. The cylinder 23 is an example of a cylinder. The piston 26 is an example of a piston.

The bumper 30 is an example of a shock absorbing member. The tip 33 is an example of a tip of the ejection part. The engagement part 56 and the place 44A are an example of a first engagement part. The wheels 39 and 69 are an example of a winding part. The hook 41, the engagement parts 65A and 66A, and the engagement parts 81 and 86 are an example of a second engagement part. The release claw 67 and the retracting part 68 is an example of a releasing mechanism. The hook guide 40 and the concave part 49 is an example of a regulating mechanism. The hanger ring 44B is an example of a first end portion. The second end portion 44C and the hanger ring 87 are an example of a second end portion. The passage 47 is an example of a passage. The passage 47 is an example of a first passage, and the lateral space E1 is an example of a second passage. The adjustment mechanism 90 is an example of an adjustment mechanism.

The first direction D1 is an example of a first direction, and the second direction D2 is an example of a second direction. The region C1 is an example of a region in which the piston is disposed. The region C2 is an example of a region in which the piston slides with respect to the cylinder. The centerline A1 is an example of a centerline, and the centerline A2 is an example of an axis.

An example of relations between matters described in some embodiments and matters disclosed in claims 11 to 15 is as follows. The driving tool 10 is an example of a driving tool. The nail 59 is an example of a fastener. The ejection part 13 is an example of an ejection part. The pressure accumulator 25 is an example of a pressure accumulator. The first direction D1 is an example of a first direction. The second direction D2 is an example of a second direction. The striking part 12 is an example of a striking part. The wire material 44 or 114 is an example of a wire material. The driving part 63 is an example of a driving part. The housing 11 is an example of a housing. The wheel 39 or 100 is an example of a rotating member. The hook 41, the engagement part 66A, 81 and 86, the movable piece 103 are an example of an engagement part.

The top dead center of the striking part 12 is an example of a predetermined position. The predetermined position is a position where the striking part 12 that is stopped is operated by a predetermined amount in the second direction. A target striking power may be obtained at the predetermined position when the striking part 12 is operated in the first direction D1. That is, the amounts by which the striking part 12 that is stopped is operated in the second direction may be the same at the predetermined position or may be different at the predetermined positions. That is, predetermined position may be the same position or may be different positions. The release lever 110 or 121 is an example of an operating member. The hook guide 106 is an example of a guide part. The first regulating part 107 is an example of a first regulating part. The second regulating part 108 is an example of a second regulating part. The solenoid actuator 117 is an example of an actuator.

The driving tool of Embodiment 1 has a configuration of each of claims 1 and 11. The driving tool of Embodiment 2 has a configuration of each of claims 1 and 11. The driving tool of Embodiment 3 has a configuration of each of claims 1 and 11. The driving tool of Embodiment 4 has a configuration of each of claims 1 and 11.

The driving tool of Embodiment 5 has a configuration of each of claims 1 and 11. The driving tool of Embodiment 5 may also include the configuration of claim 2 by adjusting and changing the circumferential length of the wire material, the position of the attachment part in the operating direction of the striking part, the position of the tip of the ejection part in the operating direction of the striking part, and the like, in the driving tool of Embodiment 5.

The driving tool is not limited to the embodiment and various modifications may be made without departing from the spirit of the present invention. For example, the electric motor may be either a brushed electric motor or a brushless electric motor. The power supply unit configured to supply electric power to the electric motor may be either a direct current power supply or an alternating current power supply. Further, terms such as clockwise and counterclockwise in the rotating elements described in Embodiment 1 to Embodiment 5 are definitions for convenience. That is, when viewed from an opposite side of 180 degrees, clockwise becomes counterclockwise, and counterclockwise becomes clockwise.

The rotating member includes a gear, a pulley, a roller, a rotating shaft, and the like. The actuator may also use a stepping motor instead of the solenoid. The housing includes a hollow casing and a body. The engagement part may have a shape or a structure that can be engaged with and disengaged from the wire material. The engagement part includes a projection, a hook, a pin, and the like. The operating member includes a lever, an arm, a plunger, a shaft, and the like.

What is claimed is:

1. A driving tool comprising:

an ejection part to which a fastener is supplied, a pressure accumulator that accumulates a compressible gas;

a striking part that is operated in a first direction to strike the fastener with a pressure of the compressible gas;

a wire material connected to the striking part;

a driving part that operates the striking part in a second direction opposite to the first direction and increase the pressure in the pressure accumulator by pulling the wire material;

a housing in which at least one of the pressure accumulators, the striking part and the driving part is provided, a cylinder that forms at least a part of the pressure accumulator and has a centerline disposed in an operating direction of the striking part; and a piston that is formed in the striking part and slid with respect to an inner circumferential surface of the cylinder when the striking part is operated in the centerline direction, wherein a connection place of the driving part and the wire material is in a region of the piston in a radial direction of the cylinder, and is outside a sliding region of the piston in the operating direction of the striking part, and on the first direction side of the piston, wherein the wire material has a first engagement part and the driving part has:

a winding part that winds the wire material by rotation; and a second engagement part that is provided on the winding part and able to be engaged with and disengaged from the first engagement part, the striking part is operated in the second direction when the winding part is rotated to wind the wire material in a state in which the second engagement part is engaged with the first engagement part, and the striking part is operated in the first direction with the pressure of the compressible gas in a state in which the second engagement part is disengaged from the first engagement part.

2. The driving tool according to claim 1, wherein the connection place of the driving part and the wire material is between a shock absorbing member with which the striking part operated in the first direction is in contact and a tip of the ejection part furthest from the shock absorbing member in the operating direction of the striking part.

3. The driving tool according to claim 1, wherein the second engagement part is rotatably provided on the winding part, the driving part has a regulating mechanism that switches between a state in which the second disengagement part does not rotate and a state in which the second disengagement part is rotatable, when the regulating mechanism causes the second engagement part to be in a non-rotating state, the second engagement part is able to be engaged with the first engagement part, and when the regulating mechanism causes the second engagement part to be in a rotatable state, the second engagement part is disengaged from the first engagement part.

4. A driving tool comprising:

an ejection part to which a fastener is supplied, a pressure accumulator that accumulates a compressible gas;

a striking part that is operated in a first direction to strike the fastener with a pressure of the compressible gas;

a wire material connected to the striking part;

a driving part that operates the striking part in a second direction opposite to the first direction and increase the pressure in the pressure accumulator by pulling the wire material;

a housing in which at least one of the pressure accumulators, the striking part and the driving part is provided, a cylinder that forms at least a part of the pressure accumulator and has a centerline disposed in an operating direction of the striking part; and a piston that is formed in the striking part and slid with respect to an inner circumferential surface of the cylinder when the striking part is operated in the centerline direction, wherein a connection place of the driving part and the wire material is in a region of the piston in a radial direction of the cylinder, outside a sliding region of the piston in the operating direction of the striking part, and on the first direction side of the piston, wherein the wire material comprises:

a first end portion connected to the striking part;

a second end portion disposed at a position opposite to the first end portion and connected to the housing; and a first engagement part disposed between the first end portion and the second end portion, the driving part comprises:

a winding part that winds the wire material by rotation; and a second engagement part that is provided on the winding part and able to be engaged with and disengaged from the first engagement part, the striking part is operated in the second direction when the winding part is rotated to wind the wire material in a state in which the second engagement part is engaged with the first engagement part, and the striking part is operated in the first direction with the pressure of the compressible gas in a state in which the second engagement part is disengaged from the first engagement part.

5. A driving tool comprising:

an ejection part to which a fastener is supplied, a pressure accumulator that accumulates a compressible gas;

a striking part that is operated in a first direction to strike the fastener with a pressure of the compressible gas;

a wire material connected to the striking part;

a driving part that operates the striking part in a second direction opposite to the first direction and increase the pressure in the pressure accumulator by pulling the wire material;

a housing in which at least one of the pressure accumulators, the striking part and the driving part is provided, a cylinder that forms at least a part of the pressure accumulator and has a centerline disposed in an operating direction of the striking part; and a piston that is formed in the striking part and slid with respect to an inner circumferential surface of the cylinder when the striking part is operated in the centerline direction, wherein a connection place of the driving part and the wire material is in a region of the piston in a radial direction of the cylinder, outside a sliding region of the piston in the operating direction of the striking part, and on the first direction side of the piston, wherein the wire material comprises:

a first end portion connected to the striking part;

a second end portion disposed at a position opposite to the first end portion; and a first engagement part disposed between the first end portion and the second end portion, the driving part comprises:

a winding part to which the second end portion is connected and winds the wire material by rotation; and a second engagement part that is provided on the winding part and able to be engaged with and disengaged from the first engagement part, the striking part is operated in the second direction when the winding part is rotated to wind the wire material in a state in which the second engagement part is engaged with the first engagement part, and the striking part is operated in the first direction with the pressure of the compressible gas in a state in which the second engagement part is disengaged from the first engagement part.

6. The driving tool according to claim 5, wherein a first passage through which the wire material passes when the striking part is operated in the first direction and a second passage through which the wire material passes when the striking part is operated in the second direction are formed in at least partially different places, the first engagement part is provided in an arc shape in a rotating direction of the winding part, the first passage is formed in an arc shape along the first engagement part, the second passage is formed at a side inward from the first passage in a radial direction of an axis that is a rotational center of the winding part, in the wire material, the second engagement part is engaged with the first engagement part and the winding part is rotated to cause the wire material to pass through the first passage, and when the second engagement part is disengaged from the first engagement part due to rotation of the winding part, the wire material is moved from the first passage to the second passage.

7. The driving tool according to claim 1, wherein an adjustment mechanism that adjusts a timing of disengaging the second engagement part from the first engagement part to a position of the striking part operated in the second direction is further provided, and the adjustment mechanism adjusts the timing of disengaging the second engagement part from the first engagement part by moving the second engagement part to the winding part in the rotating direction.

8. The driving tool according to claim 1, wherein a casing that forms the pressure accumulator together with the cylinder is provided in the housing, and the wire material is disposed throughout an inside of the housing, an outside of the cylinder and an outside of the casing.

9. The driving tool according to claim 1, wherein the wire material is disposed outside a region of a place of the pressure accumulator formed in the cylinder in the operating direction of the striking part and outside a region of a place of the pressure accumulator formed in the cylinder in the radial direction of the cylinder.

10. A driving tool comprising:

an ejection part to which a fastener is supplied;

a pressure accumulator that accumulates a compressible gas;

a striking part operated in a first direction to strike the fastener with a pressure of the compressible gas;

a wire material connected to the striking part;

a driving part that operates the striking part in a second direction opposite to the first direction and increase the pressure in the pressure accumulator by pulling the wire material; and a housing in which at least one of the pressure accumulators, the striking part and the driving part is provided, wherein the driving part comprises:

a rotating member; and an engagement part that is provided on the rotating member and able to be engaged with and disengaged from the wire material, and the rotating member is rotated to pull the wire material in a state in which the engagement part is engaged with the wire material.

11. The driving tool according to claim 10, wherein the engagement part is disengaged from the wire material when the striking part reaches a predetermined position in the second direction after the rotating member is rotated and the striking part is operated in the second direction in a state in which the engagement part is engaged with the wire material.

12. The driving tool according to claim 11, wherein an operating member that is operable and stoppable is provided in the housing, and the engagement part is disengaged from the wire material by operating the operating member and rotating the engagement part when the striking part reaches the predetermined position.

13. The driving tool according to claim 12, further comprising:

a casing in which the rotating member is accommodated; and a guide part that is provided in the casing and restricts rotation and stop of the engagement part with respect to the rotating member, wherein the guide part comprises:

a first regulating part that stops the engagement part with respect to the rotating member; and a second regulating part that rotates the engagement part with respect to the rotating member, and the engagement part is disengaged from the wire material when the second regulating part rotates the engagement part.

14. The driving tool according to claim 12, wherein the operating member is operated by an actuator operated by a force applied in the second direction by the striking part, or provided in the housing and operated with electric power.

* * * * *